US006785494B2

(12) United States Patent
Yamanoi et al.

(10) Patent No.: US 6,785,494 B2
(45) Date of Patent: Aug. 31, 2004

(54) IMAGE FORMATION APPARATUS AND CHARGER USED THEREWITH

(75) Inventors: Kazuya Yamanoi, Iwatsuki (JP); Shigeo Ohno, Iwatsuki (JP); Shigeki Nishimura, Iwatsuki (JP); Yasuyuki Tsutsumi, Iwatsuki (JP); Ryuichi Yamamoto, Iwatsuki (JP); Yusuke Kitagawa, Iwatsuki (JP); Noritaka Ide, Iwatsuki (JP); Tadashi Kiyama, Iwatsuki (JP); Masahiro Satoh, Iwatsuki (JP); Toshio Masubuchi, Iwatsuki (JP); Hiromitsu Koizumi, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 188 days.

(21) Appl. No.: 10/055,913

(22) Filed: Jan. 28, 2002

(65) Prior Publication Data

US 2003/0012584 A1 Jan. 16, 2003

(30) Foreign Application Priority Data

| | | |
|---|---|---|
| Jul. 12, 2001 | (JP) | 2001-212923 |
| Jul. 12, 2001 | (JP) | 2001-212924 |
| Jul. 12, 2001 | (JP) | 2001-212925 |
| Jul. 19, 2001 | (JP) | 2001-220378 |
| Jul. 19, 2001 | (JP) | 2001-220388 |

(51) Int. Cl.[7] ..... G03G 15/02
(52) U.S. Cl. ..... 399/174; 399/168
(58) Field of Search ..... 399/174, 175, 399/176, 168, 50, 353

(56) References Cited

U.S. PATENT DOCUMENTS

| | | | | |
|---|---|---|---|---|
| 4,741,942 A | * | 5/1988 | Swift | 399/175 X |
| 5,799,233 A | * | 8/1998 | Ishii et al. | 399/175 |
| 5,822,169 A | * | 10/1998 | Yoshioka et al. | 399/174 X |
| 5,999,776 A | * | 12/1999 | Abe et al. | 399/176 |
| 6,594,461 B2 | * | 7/2003 | Ohno et al. | 399/174 |

FOREIGN PATENT DOCUMENTS

| | | | |
|---|---|---|---|
| JP | 4-371975 | | 12/1992 |
| JP | 6-149019 | * | 5/1994 |
| JP | 9-054480 | | 2/1997 |
| JP | 9-160347 | * | 6/1997 |
| JP | 10-31346 | * | 2/1998 |
| JP | 11-109718 | * | 4/1999 |
| JP | 11-249452 | | 9/1999 |

* cited by examiner

*Primary Examiner*—Fred Braun
(74) *Attorney, Agent, or Firm*—Oliff & Berridge, PLC

(57) ABSTRACT

An image formation apparatus including a photoreceptor, a charger having a charger member for charging the photoreceptor, a latent image write unit for writing an electrostatic latent image onto the photoreceptor charged by the charger, and a developing device having a developer support with a magnetic field production member, for rendering visible the electrostatic latent image written by the latent image write unit with a developer. Further, the charging member of the charger is disposed under effect of a magnetic field produced by the magnetic field production member of the developing device, and the charging member is made of a nonmagnetic material.

33 Claims, 32 Drawing Sheets

MODEL ACCORDING TO FIRST EMBODIMENT

COMPARATIVE MODEL

FIG.15(a)

●END PART SPOT CAUSED BY BCO/CARRIER SCATTER

| | | PAPER END PART POSITION | DISTANCE BETWEEN PAPER END PART AND BLAST END PART | | |
|---|---|---|---|---|---|
| | | | 3mm | 4mm | 5mm |
| DISTANCE BETWEEN THIN LAYER AREA REGULATION POSITION AND BLAST END PART | 0mm | × | ○ | △ | △ |
| | 1mm | – | △ | ○ | ○ |
| | 2mm | – | △ | ○ | ○ |

FIG.15(b)

●FOGGING AT UPPER END PART OF PHOTOCONDUCTIOR DRUM

| | | PAPER END PART POSITION | DISTANCE BETWEEN PAPER END PART AND BLAST END PART | | |
|---|---|---|---|---|---|
| | | | 3mm | 4mm | 5mm |
| DISTANCE BETWEEN THIN LAYER AREA REGULATION POSITION AND BLAST END PART | 0mm | × | △ | △ | △ |
| | 1mm | – | △ | ○ | ○ |
| | 2mm | – | ○ | ○ | ○ |

※SHUT DOWN DURING PRINT, TAPE TRANSFER

FIG.15(c)

●DIRTY LEVEL OF DRIVER GEAR IN PERIPHERY OF DEVELOPING ROLL END PART

| | | PAPER END PART POSITION | DISTANCE BETWEEN PAPER END PART AND BLAST END PART | | |
|---|---|---|---|---|---|
| | | | 3mm | 4mm | 5mm |
| DISTANCE BETWEEN THIN LAYER AREA REGULATION POSITION AND BLAST END PART | 0mm | × | △ | ○ | ○ |
| | 1mm | – | ○ | ○ | ○ |
| | 2mm | – | ○ | ○ | ○ |

FIG.16
CHARGING SHAFT : SUM
REFRESHER SHAFT : SUM
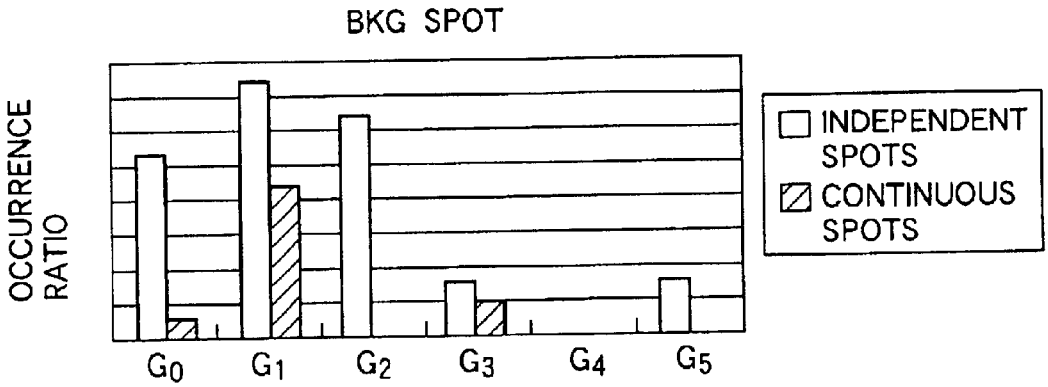
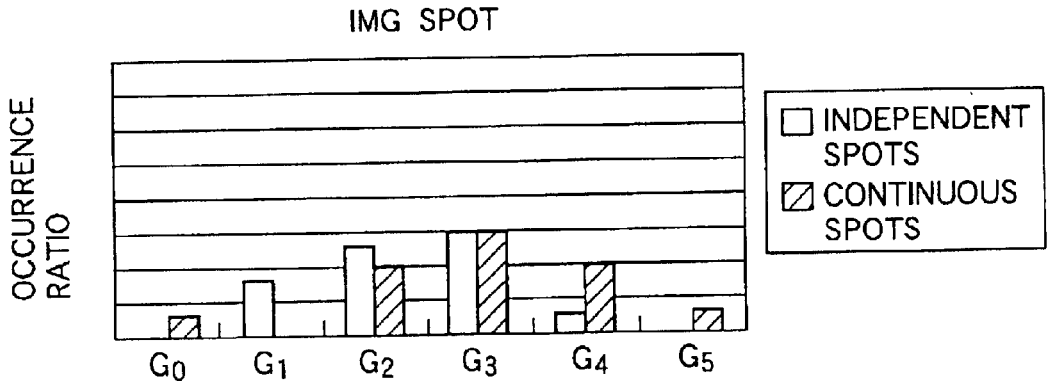

FIG.17
CHARGING SHAFT : SUS303Cu
REFRESHER SHAFT : SUM
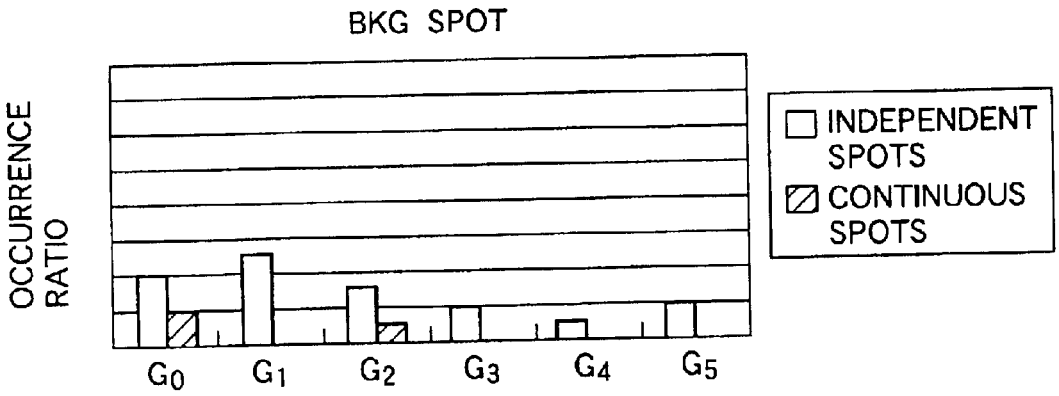
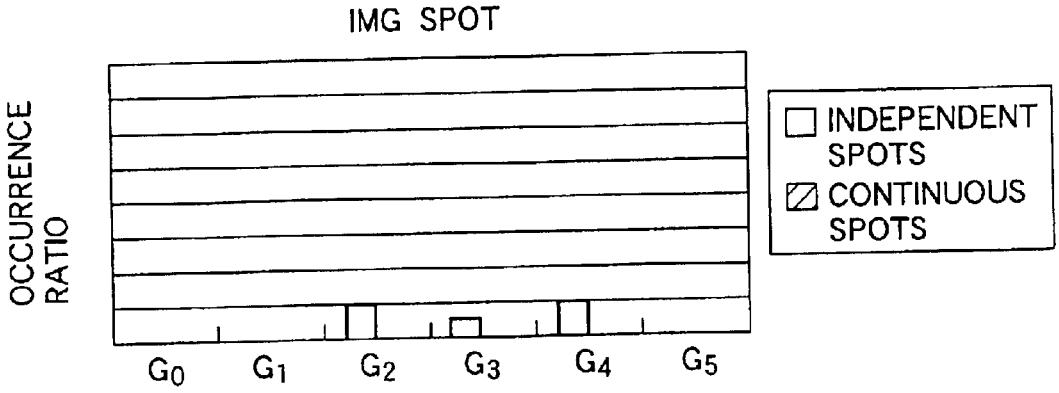

FIG.18
CHARGING SHAFT : SUS303Cu
REFRESHER SHAFT : SUS303Cu
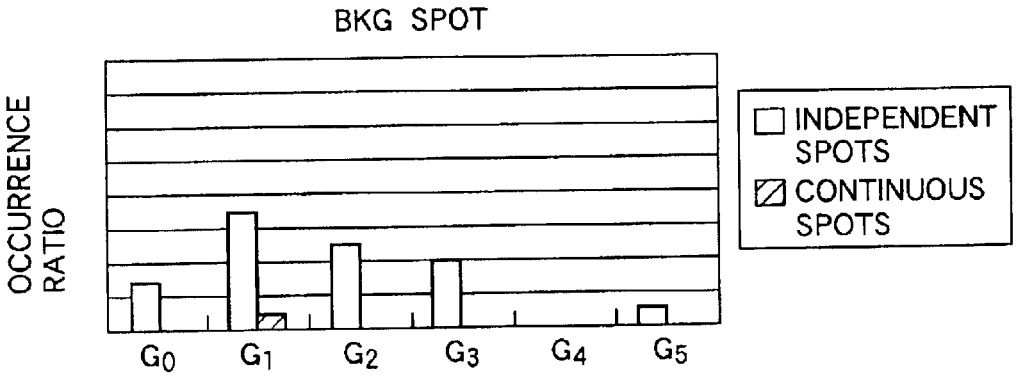
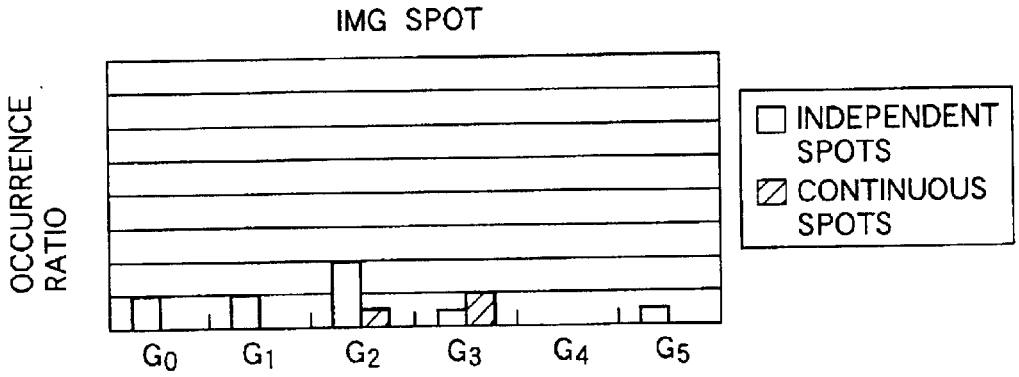

| d(mm) | OCCURRANCE OF SPOT |
|---|---|
| 0 (CONTACT) | ○ |
| 0.5 | ○ |
| 1.0 | ○ |
| 2.0 | ○ |
| 3.0 | ○ |
| 4.0 | × |

IMAGE FORMATION APPARATUS AND CHARGER USED THEREWITH

BACKGROUND OF THE INVENTION

1. Field of the Invention

This invention relates to an image formation apparatus such as a copier or a printer and in particular to improvements in an image formation apparatus of the type comprising a charger having a charging member in contact with or brought close to the top of an photoreceptor and a charger used with the image formation apparatus.

2. Description of the Related Art

In recent years, demands for miniaturizing a color image formation apparatus and devises thereof have been made as the demands of the market.

For example, a tandem image formation apparatus comprises a plurality of photoreceptors such as photoconductor drums and devices such as a charger and a developing device disposed on each of the photoreceptors. As the apparatus itself is miniaturized, inevitably the developing device and the charger are placed close to each other and a new technical problem of interference between the devices, which has been no particular problem so far, is found.

To miniaturize the apparatus itself, a so-called cleanerless system wherein a cleaning device and a remaining toner collection device are not provided for each photoreceptor is proposed.

However, in this kind of cleanerless system, after transfer, remaining toner exists on the photoreceptor surface although a trace quantity of toner remains, and the remaining toner becomes "memory" at the next image formation time, adversely affecting the image quality.

Thus, in a related art, for example, an art has been proposed wherein a memory removal member (for example, a brush roll) is placed in the upstream of a charger member (for example, a charge brush) as a charger to disturb the remaining toner (for example, refer to JP-A-Hei.4-371975).

In this kind of related art, a technique of applying a bias to the memory removal member to remove the remaining toner easily is disclosed.

When a toner is accumulated in the memory removal member with the long-term use, it becomes difficult to accomplish the original object and thus, for example, a technique of temporarily holding the remaining toner and discharging and collecting the remaining toner at a predetermined timing has been already proposed (for example, refer to JP-A-Hei.11-249452).

An image formation apparatus in a related art uses, for example, a charger of a charging roll type.

As this kind of charger, for example, a charger comprising a sponge-like conductive elastic body placed on a metal shaft and coated on a surface with a fluorine resin film (PVdF) has been already proposed.

As a technical problem of this kind of image formation apparatus (charger), for example, using a charger of a charging roll type, a phenomenon in which random spots are produced at arbitrary points on paper or continuous-points or spots are produced every rotation period of a charging roll or a photoconductor drum (P/R), for example, is observed, as shown in FIG. 19.

A similar phenomenon is also observed if a charger of a charging roll type is used or in an image formation apparatus adopting a developing device of a dual-component developing type, a charger comprising a brush roll placed upstream from a charging member (for example, a charging roll) is used.

The spots are roughly classified into background spots (BKG spots) occurring in a background and image part spots occurring in an image part (for example, a halftone image), as shown in FIG. 19.

Next, the production principle of such spots is estimated. For example, as shown in FIG. 20, when a foreign substance 502 is deposited on a photoconductor drum 510 and enters a nip area between a charging roll 511 and the photoconductor drum 510, the foreign substance 502 portion shields an electric field and a tenting part is formed on a surface layer film portion of the charging roll 511 in which the foreign substance 502 intervenes so that a charge failure is caused in a part corresponding to the photoconductor drum 510 portion.

At this time, if the charge failure part caused by the foreign substance 502 shifts to the downstream of the photoconductor drum 510 and an electrostatic latent image is formed in the charge failure part and is developed, a spot having a comparatively large diameter is produced.

On the other hand, if the foreign substance 502 is deposited on the charging roll 511 or the photoconductor drum 510, a continuous point is produced every rotation period of the charging roll 511 or the photoconductor drum 510.

Since the surface layer film of the charging roll 511 uses a rigid fluorine resin film (PVdF) having a Young's modulus of 2 GPa, the contact property between the charging roll 511 and the photoconductor drum 510 surface is poor and the discharge gap on a prenip side is unstable and becomes large in curvature and a so-called charge ghost that the previous latent image history remains because of abnormal discharge occurs.

Further pursuing the production cause of such spots, we have determined that the main cause of producing the spots is the fact that as the developing device and the charger are placed close to each other, the magnetic force from the developing device affects a shaft (usually, using a magnetic material) of the charging roll and a magnetic material of carrier, etc., is easily deposited on the surface of the charging roll because of magnetic field interference between the developing device and the shaft.

In the form in which the brush roll is placed in the upstream of the charging member (for example, a charging roll), toner and a developer (carrier) accumulate on the brush roll and drop as an aggregate on the surface of an photoreceptor as the brush roll rotates.

Particularly, the carrier is large as it has a particle diameter of 40 to 50 $\mu$m and if charges, etc., are poured into the carrier by the bias applied to the brush roll, the polarity changes and the carrier easily aggregates and drops onto the photoreceptor as a coarse lump. If the carrier lump enters the charging member, the contact between the charging member and the photoreceptor surface becomes nonuniform to cause a partial charge failure to occur so that the image quality is widely affected. Specifically, a technical problem leading to the image quality defect like spots described above arises.

The carrier of the developer constantly leaks to the photoreceptor surface little by little in the developing section and easily flows out under a low-temperature, low-humidity environment or over time.

As means for handling the carrier lump, an art wherein a brush roll is provided with a flicker (a member for flicking a developer) for scrubbing away the developer deposited on the brush roll is disclosed (for example, refer to JP-A-Hei.9-54480).

However, in this technique, the possibility that the developer will scatter in the main unit of the apparatus is high and a mechanism for collecting the scrubbed developer needs to be provided; the technique is not a preferred solution from the points of mounting costs and an increase in space.

SUMMARY OF THE INVENTION

The invention is intended for solving the above-described technical problems and it is an object of the invention to provide an image formation apparatus intended for effectively avoiding a detrimental effect caused by magnetic field interference between a developing device and a charger and a charger used with the image formation apparatus.

It is another object of the invention to provide an image formation apparatus for making is possible to well avoid an image quality defect like spots according to a simple configuration and a charger used with the image formation apparatus.

It is still another object of the invention to provide an image formation apparatus for making is possible to effectively prevent an image quality defect like spots and a charge ghost from occurring as a surface layer film material of a charging member is optimized and a charger used with the image formation apparatus.

According to the invention, there is provided an image formation apparatus comprising:

a photoreceptor;

a charger having a charging member for charging the photoreceptor;

a latent image write unit for writing an electrostatic latent image onto the photoreceptor charged by the charger; and a developing device having a developer support including a magnetic field production member, the developing device for rendering visible the electrostatic latent image written by the latent image write unit with a developer, wherein the charging member of the charger is disposed under effect of a magnetic field produced by the magnetic field production member of the developing device; and the charging member is made of a nonmagnetic material.

BRIEF DESCRIPTION OF THE DRAWINGS

FIG. 15(*a*) is a schematic representation of an evaluation of end part spots caused by BCO/carrier scatter as changing distance between a thin layer area regulation position and blast end part and distance between a paper end part and blast end part in example 1, FIG. 15(*b*) is a schematic representation of an evaluation of fogging at an upper end part of a photoconductor drum as similarly changing the parameters to that in FIG. 15(*a*), and FIG. 15(*c*) is a schematic representation of an evaluation of the dirty level of a drive gear in the periphery of a developing roll end part as similarly changing the parameters to that in FIG. 15(*a*).

FIG. 16 is a schematic representation to show an occurrence state of background spots and image spots in a comparative example 1.

FIG. 17 is a schematic representation to show the occurrence state of background spots and image spots in example 2.

FIG. 18 is a schematic representation to show an occurrence state of background spots and image spots in example 3.

DESCRIPTION OF THE INVENTION

Figure 1A:
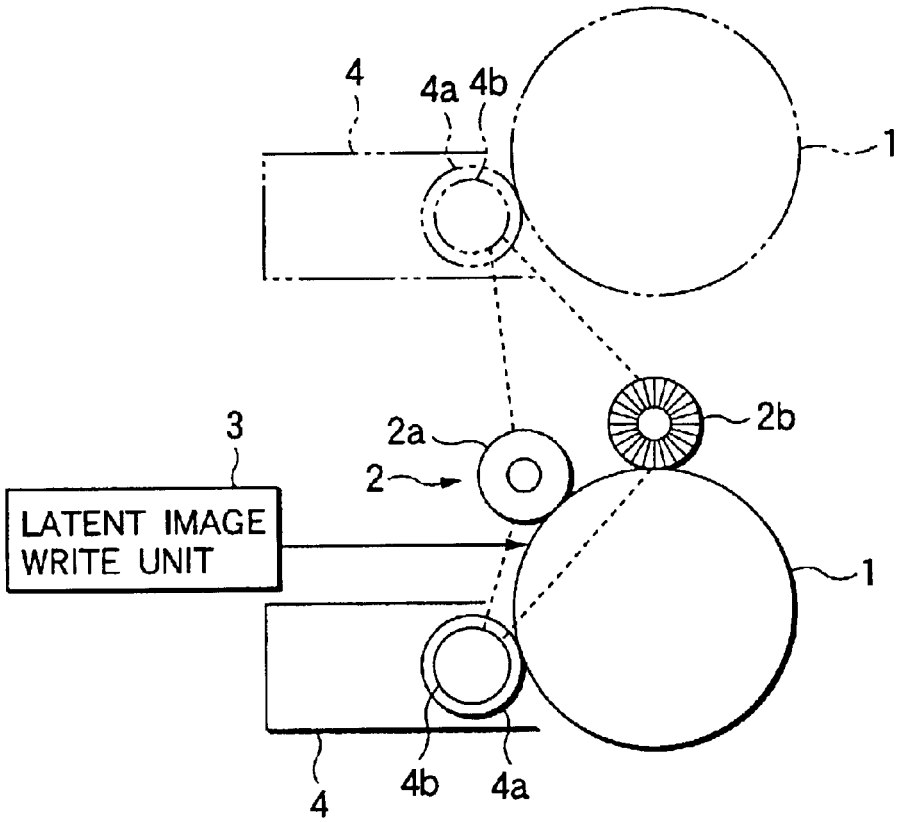
FIG. 1(*a*) is a schematic representation to show an outline of an image formation apparatus and a charger used therewith according to the invention and FIG. 1(*b*) is a schematic representation of the main part thereof.

According to a first aspect of the invention, there is provided an image formation apparatus comprising an photoreceptor 1, a charger 2 having a charging member 2*a* placed in contact with or close to the photoreceptor 1, the charger 2 for charging the photoreceptor 1, a latent image write unit 3 for writing an electrostatic latent image onto the photoreceptor 1 charged by the charger 2, and a developing device 4 having at least a developer support 4*a* containing a magnetic field production member 4*b*, the developing device for rendering visible the electrostatic latent image written by the latent image write unit 3 with a developer, characterized in that the charging member 2*a* of the charger 2 is disposed under the effect of a magnetic field produced by the magnetic field production member 4*b* of the developing device 4 and is made of a nonmagnetic material.

In such technical means, the charging member 2*a* is required to be placed in contact with or close to the photoreceptor 1.

A mode in which the charging member 2*a* is placed out of contact with the photoreceptor 1 is also included, considering that it is possible to charge by minute space discharge even in the mode in which the charging member 2*a* is placed close to the photoreceptor 1.

However, preferably the charging member 2*a* is placed in contact with the photoreceptor 1 because positioning the charging member 2*a* relative to the photoreceptor 1 is facilitated and the dimension accuracy of the charging member 2*a* need not be high.

The expression "is disposed under the effect of a magnetic field produced by the magnetic field production member 4*b* of the developing device 4" is on the assumption that the charging member 2*a* is under the magnetic field effect of the developing device 4 as the whole image formation apparatus is miniaturized.

Further, a part of the charging member 2*a* may be placed under the magnetic field effect and not all need be under the magnetic field effect.

The main purpose of making the charging member 2*a* of a nonmagnetic material is to make the charging member 2*a* hard to be magnetized for effectively avoiding deposition of carrier, which is a magnetic material.

As the nonmagnetic material, any may be selected appropriately so long as carrier, which is a magnetic material, is not deposited thereon. For example, preferably, the charging member 2*a* is made of a nonmagnetic material having magnetic permeability of 1.05 or less (for example, SUS303). More preferably, the charging member 2*a* is made of a nonmagnetic material having magnetic permeability in a range of 1 to 1.05, further more preferably, in a range of 1 to 1.02.

Particularly, preferably the charging member 2*a* is made of a nonmagnetic material in which copper is added to SUS303 (hereinafter, refer to SUS303Cu as required).

SUS303Cu is preferred in that SUS303Cu has magnetic permeability of 1.02 or less and that SUS303Cu is less changed by heat treatment, extension, or cutting work than SUS303 and moreover has good cut workability (low cost).

Figure 1B:
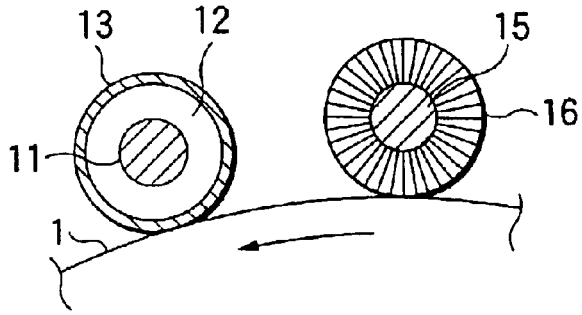

Further, as the charging member 2*a*, any may be selected appropriately so long as the charging member 2*a* is a functional member for charging the photoreceptor 1. Typically, the charging member 2*a* may comprise a sponge-like conductive elastic body 12 on a nonmagnetic shaft 11, as shown in FIG. 1(*b*).

In this case, "sponge-like body" is preferred in that hardness can be lowered and a stable nip width can be taken to stably charge.

Particularly, in view of maintaining a uniform charge property onto the photoreceptor 1, it is preferable that the charging member 2*a* comprises a sponge-like conductive elastic body 12 on a nonmagnetic shaft 11 and an outer periphery of the conductive elastic body 12 is coated with a cylindrical surface layer film 13.

At this time, the "surface layer film 13" is preferred in that the surface of the charging member 2*a* is kept smooth and the charge property is made uniform. That is, the surface layer film 13 is preferred in that the surface layer film 13 is easily electrostatically attracted to the photoreceptor 1 and nip uniformity is easily provided by an electrostatic attraction force.

As a representative mode of the charging member 2*a*, for example, the sponge-like conductive elastic body 12 may be a conductive urethane foam and the cylindrical surface layer film 13 may be made of a conductive fluorine resin.

As a resistance condition of the charging member 2*a*, preferably the charging member 2*a* has the surface resistance value in a range of $10^6$ Ω/□ to $10^{8.5}$ Ω/□.

The reason why the surface resistance value is in the range of "$10^6$ Ω/□ to $10^{8.5}$ Ω/□" is that if the value is too large, the charging member 2*a* does not function; if the value is too small, charge current leakage accompanying a charge failure easily occurs.

Further, preferably a hardness condition of the charging member 2*a* is 90 degrees or less in Asker F hardness, more preferably, 60 degree or less in Asker F hardness.

The reason why the charging member 2*a* has Asker Fhardness of "90 degrees or less" is that if the charging member 2*a* has Asker F hardness exceeding 90 degrees, nip uniformity is poor and a charge failure easily occurs.

Further, as a strength condition of the charging member 2*a*, preferably the charging member 2*a* comprises the nonmagnetic shaft 11 having a tensile strength of 600 N/mm$^2$ or more.

If such a strength condition is satisfied, bend deformation at the center part of the charging member 2*a* can be prevented and a charge property can be provided over all regions.

As a bias applying condition to the charging member 2*a*, preferably a charge bias of DC voltage is applied to the charging member 2*a*.

For example, if AC voltage is superposed, abrasion (discharge stress) caused by applying voltage to the photoreceptor 1 such as a photoconductor or the like easily occurs and from the viewpoint of preventing the abrasion (discharge stress), it is preferable that the charge bias of DC voltage is applied.

Further, a charge bias different in polarity may be applied to the charging member 2*a*.

This is required for removing opposite-polarity toner deposited on the charging member 2*a* during execution of a cleaning mode.

The invention more exerts the technical effect under a condition that carrier, which is a magnetic material, is easily deposited on the photoreceptor 1 and the charging member 2*a*.

As the condition that the carrier is easily deposited, there are given examples that a mode in which, for example, the developer support 4*a* of the developing device 4 rotates at the number of revolutions to such an extent that a part of the developer scatters against a magnetic force produced by the magnetic filed production member 4*b*, a mode in which as a magnetic force pattern of the magnetic filed production member 4*b* of the developing device 4, for example, the magnetic filed production member 4*b* comprises a developing magnetic pole having 100 mT or more and an adjacent magnetic pole having 50 mT or more at a part adjacent to the developing magnetic pole, and a mode in which a developing bias with an AC component superposed on a DC component is applied to the developer support 4*a* of the developing device 4.

Further, the charger 2 basically may comprise the charging member 2*a*, but the invention is not always limited to this. For example, the following mode may be adopted:

According to the invention, as shown in FIG. 1, there is provided an image formation apparatus comprising an photoreceptor 1, a charger 2 having a charging member 2*a* placed in contact with or close to the photoreceptor 1, for charging the photoreceptor 1, a latent image write unit 3 for writing an electrostatic latent image onto the photoreceptor 1 charged by the charger 2, and a developing device 4 having at least a developer support 4*a* containing a magnetic field production member 4*b* for rendering visible the electrostatic latent image written by the latent image write unit 3 with a developer, characterized in that the charger 2 has the charging member 2*a* and a removal member 2*b* disposed in the upstream of the charging member 2*a* to contact with the photoreceptor 1, for removing a deposit on the photoreceptor 1, that the charging member 2*a* is disposed under the effect of a magnetic field produced by the magnetic field production member 4*b* of the developing device 4 and is made of a nonmagnetic material, and that, on the other hand, the removal member 2*b* is disposed under the effect of a magnetic field produced by the magnetic field production member 4*b* of the developing device 4 and is made of a magnetic material, as shown in FIG. 1.

That is, the charger 2 of this mode comprises "charging member 2*a*+removal member 2*b*."

In the mode, the removal member 2*b* may be any so long as the removal member 2*b* is of contact type for removing the deposit on the photoreceptor 1 (for example, carrier C, opposite-polarity toner, etc.,) and the removal member 2*b* serves as a functional member for eliminating an accident in which the deposit on the photoreceptor 1 leads to the charging member 2*a* and for keeping a good charge property.

It is noted that the removal member 2*b* may be integral with the charging member 2*a* in one unit or may be separate from the charging member 2*a*.

The removal member 2*b* typically is assumed to be a refresher for temporarily holding a deposit, but also includes a contact-type cleaning member of a normal cleaning device with respect to the function.

The surface deposit of the refresher is collected into another cleaning device in a cleaning mode (see "DETAILED DESCRIPTION OF THE PREFERRED EMBODIMENTS"), etc., for example.

Further, the removal member 2*b* is limited to the contact type from the viewpoint of providing removability, but various modes of the removal member 2*b* such as brush-like mode and blade-like mode are possible.

At least a part of the removal member 2*b* is also required to be disposed under the effect of a magnetic field.

Further, the reason why the removal member 2*b* is made of a "magnetic material" is that as the removal member 2*b* is magnetized, trapping the carrier on the photoreceptor 1 is facilitated.

Next, preferred modes of the removal member 2*b* will be discussed.

Preferably, the removal member 2*b* is provided with a brush-like member 16 on a magnetic shaft 15 from the viewpoint of compatibility between removability of the removal member 2*b* and damage prevention to the photoreceptor 1.

In this mode, for example, the removal member 2*b* may comprise a magnetic shaft 15 made of SUM.

"SUM" is preferred in easy work and low cost.

The removal member 2*b* may comprise a magnetic shaft 15 made of SUM having a surface plated with nickel.

"SUM+being plated with Ni" is preferred in sliding noise prevention and rust prevention.

Further, as a preferred manufacturing method of the brush-like member 16, the removal member 2*b* is provided with the brush-like member 16 by bonding a fiber-like member onto the magnetic shaft 15.

As a preferred material of the brush-like member 16, the brush-like member 16 may be made of an acrylic resin; in addition, PP, rayon, nylon, polyester, PTFE, ETFT, PET, etc., is available as the material of the brush-like member 16.

Further, as a resistance condition of the removal member 2*b*, preferably the resistance value is in a range of $10^4$ to $10^5$ Ωcm.

The resistance condition is set to provide compatibility between cleaning property and environment dependency.

The "resistance value" means the volume resistance value of the brush-like member (fiber), for example.

Preferably, a predetermined removal bias is applied to the removal member 2*b* from the viewpoint of removing opposite-polarity toner, etc.

Particularly, it is advisable to apply a removal bias different in polarity to the removal member 2*b*.

This is required to remove the opposite-polarity toner deposited on the removal member 2*b* during execution of the cleaning mode.

Further, the first aspect of the invention is useful for applying the first aspect of the invention to an upright tandem image formation apparatus.

As an application example, in an image formation apparatus, a plurality of the photoreceptors 1, a plurality of the chargers 2, and a plurality of the developing devices 4 are disposed in a vertical direction, any of the chargers 2 are disposed at an intermediate position between the developing devices 4 positioned consecutively up and down, and the charging member 2*a* of the charger 2 is positioned roughly below a developing part of the upper developing device 4.

In this mode, in the upright tandem, carrier deposition easily occurs due to the layout in addition to magnetic field interference between the developing device 4 and the charger 2.

As another application example of the first aspect of the invention, in an image formation apparatus, a plurality of the photoreceptors 1, a plurality of the chargers 2, and a plurality of the developing devices 4 are disposed in a vertical direction, any of the chargers 2 are disposed at an intermediate position between the developing devices 4 positioned consecutively up and down, and the charging member 2*a* of the charger 2 is disposed under the effect of the magnetic field produced by the magnetic field production member 4*b* of each of the developing devices 4 positioned consecutively up and down.

This mode is an example in which magnetic field interference between the developing device 4 and the charger 2 is noticeable in the upright tandem.

Further, in an upright tandem image formation apparatus using the charger 2 of the "charging member 2*a*+removal member 2*b*" type, as a preferred layout example of the removal member 2*b*, a plurality of photoreceptors 1, a plurality of chargers 2, and a plurality of developing devices 4 are disposed in a vertical direction, any of the chargers 2 are disposed at an intermediate position between the developing devices 4 positioned consecutively up and down, and the removal member 2*a* of the charger 2 is positioned roughly below a developing part of the upper developing device 4.

Further, as another layout example, a plurality of photoreceptors 1, a plurality of chargers 2, and a plurality of developing devices 4 are disposed in a vertical direction, any of the chargers 2 are disposed at an intermediate position between the developing devices 4 positioned consecutively up and down, and the removal member 2*a* of the charger 2 is disposed under the effect of the magnetic field produced by the magnetic field production member 4*b* of each of the developing devices 4 positioned consecutively up and down.

As developer toner, spherical toner having a form factor of 130 or less maybe used from the viewpoint of easily providing high image quality and a cleanerless system.

The first aspect of the invention is not limited to the image formation apparatus and is also applied to the charger itself used with the image formation apparatus.

In this case, according to the first aspect of the invention, as shown in FIG. 1, there is provided a charger being built in an image formation apparatus comprising a developing device 4 having at least a developer support 4*a* containing a magnetic field production member 4*b*, for rendering visible an electrostatic latent image on an photoreceptor 1 with a developer, the charger for charging the photoreceptor 1, characterized in that the charger comprises a charging member 2*a* placed in contact with or close to the photoreceptor 1 and the charging member 2*a* is disposed under the effect of a magnetic field produced by the magnetic field production member 4*b* of the developing device 4 and is made of a nonmagnetic material.

According to the first aspect of the invention, which is applied to the charger 2 of the "charging member 2*a*+removal member 2*b*" type, there is provided a charger being built in an image formation apparatus comprising a developing device 4 having at least a developer support 4*a* containing a magnetic field production member 4*b*, for rendering visible an electrostatic latent image on an photoreceptor 1 with a developer, the charger for charging the photoreceptor 1, characterized in that the charger comprises a charging member 2*a* placed in contact with or close to the photoreceptor 1 and a removal member 2*b* disposed in contact with the photoreceptor 1 in the upstream of the charging member 2*a*, the removal member 2*b* for removing a deposit on the photoreceptor 1, that the charging member 2*a* is disposed under the effect of a magnetic field produced by the magnetic field production member 4*b* of the developing device 4 and is made of a nonmagnetic material, and that the removal member 2*b* is disposed under the effect of a magnetic field produced by the magnetic field production member 4*b* of the developing device 4 and is made of a magnetic material, as shown in FIG. 1.

Next, a second aspect of the invention will be discussed. Members identical with those of the first aspect of the invention are denoted by the same reference numerals in the second aspect of the invention and will not be discussed again.

According to the second aspect of the invention, there is provided an image formation apparatus comprising an photoreceptor 1, a charger 2 having a charging member 2*a* being placed in contact with or close to the photoreceptor 1 for charging the photoreceptor 1, a latent image write unit 3 for writing an electrostatic latent image onto the photoreceptor 1 charged by the charger 2, and a developing device 4 having at least a developer support 4*a* containing a magnetic field production member 4*b*, for rendering visible the electrostatic latent image written by the latent image write unit 3 with a developer, characterized in that the charger 2 comprises the charging member 2*a*, a removal member 2*b* disposed in contact with the photoreceptor 1 in the upstream of the charging member 2*a*, the removal member 2*b* for removing a deposit on the photoreceptor 1, and a partition member 2*c* for partitioning the charging member 2*a* and the removal member 2*b* and for causing a removed substance peeled off from the removal member 2*b* to collide with the partition member 2*c*.

The charger 2 is assumed to comprise "charging member 2*a*+removal member 2*b*."

For the partition member 2*c*, material, shape, etc., may be selected appropriately so long as the partition member 2*c* works so as to partition the charging member 2*a* and the removal member 2*b* and destroy the removed substance peeled off from the removal member 2*b* (mainly, carrier lump) as the removed substance is made to collide with the partition member 2*c*.

Further, preferred modes of the partition member 2*c* will be discussed.

Preferably, the partition member 2*c* is placed out of contact with the photoreceptor 1.

Here, preferably the partition member 2*c* is placed out of contact with the photoreceptor 1 from the viewpoint of damage prevention to the photoreceptor 1 and accumulation prevention of removed substances.

On the other hand, as a mode wherein the partition member 2*c* is placed in contact with the photoreceptor 1, for example, an elastic piece may be provided at an end part of the partition member and be brought into elastic contact with the photoreceptor 1.

The setting reference of the projection dimension of the partition member 2*c* may be selected appropriately; preferably the partition member 2*c* extends to below a line connecting the rotation centers of the charging member 2*a* and the removal member 2*b*.

This mode shows a layout example in which the removed substance peeled off from the removal member 2*b* easily collides with the partition member 2*c*.

Further, preferably, the partition member 2*c* is placed out of contact with the removal member 2*b*.

This is intended for avoiding an accident in which the removed substance by the removal member 2*b* again comes in contact with the partition member 2*c* (flicking) and thus again scatters easily.

Further, abias maynot be applied to the partition member 2*c*; preferably a suction bias of the same polarity as a charge bias is applied to the partition member 2*c*.

According to this mode, it is preferred to attract surface carrier of the carrier on the removal member 2*b* onto the partition member 2*c* side and to hold the surface carrier.

The material of the partition member 2*c* may be selected appropriately; in a mode in which the partition member 2*c* is disposed under the effect of a magnetic field produced by the magnetic field production member 4*b* of the developing device 4 in modes in which the charger 2 and the developing device 4 are placed close to each other, preferably the partition member 2*c* is made of a magnetic material.

According to this mode, as the partition member 2*c* is magnetized, trapping of carrier peeled off from the removal member 2*b* and the like can be facilitated.

Further, the attachment structure of the charging member 2*a*, the removal member 2*b*, and the partition member 2*c* may be selected appropriately; as a preferred attachment structure, the charging member 2*a*, the removal member 2*b*, and the partition member 2*c* are positioned and supported on a common support frame and are assembled through the support frame into a main unit of the apparatus in one piece.

The second aspect of the invention is not limited to the image formation apparatus and is applied to the charger itself used with the image formation apparatus.

In this case, according to the second aspect of the invention, there is provided a charger being built in an image formation apparatus comprising a developing device 4 having at least a developer support 4*a* containing a magnetic field production member 4*b*, for rendering visible an electrostatic latent image on an photoreceptor 1 with a developer, the charger for charging the photoreceptor 1, wherein the charger comprises a charging member 2*a* placed in contact with or close to the photoreceptor 1, a removal member 2*b* disposed in contact with the photoreceptor 1 in the upstream of the charging member 2*a*, the removal member 2*b* for removing a deposit on the photoreceptor 1, and a partition member 2*c* for partitioning the charging member 2*a* and the removal member 2*b* and for causing a removed substance peeled off from the removal member 2*b* to collide with the partitioning member 2*c*.

Next, a third aspect of the invention will be discussed. Members identical with those of the first and second aspects of the invention are denoted by the same reference numerals in the third aspect of the invention and will not be discussed again.

Figure 22A:
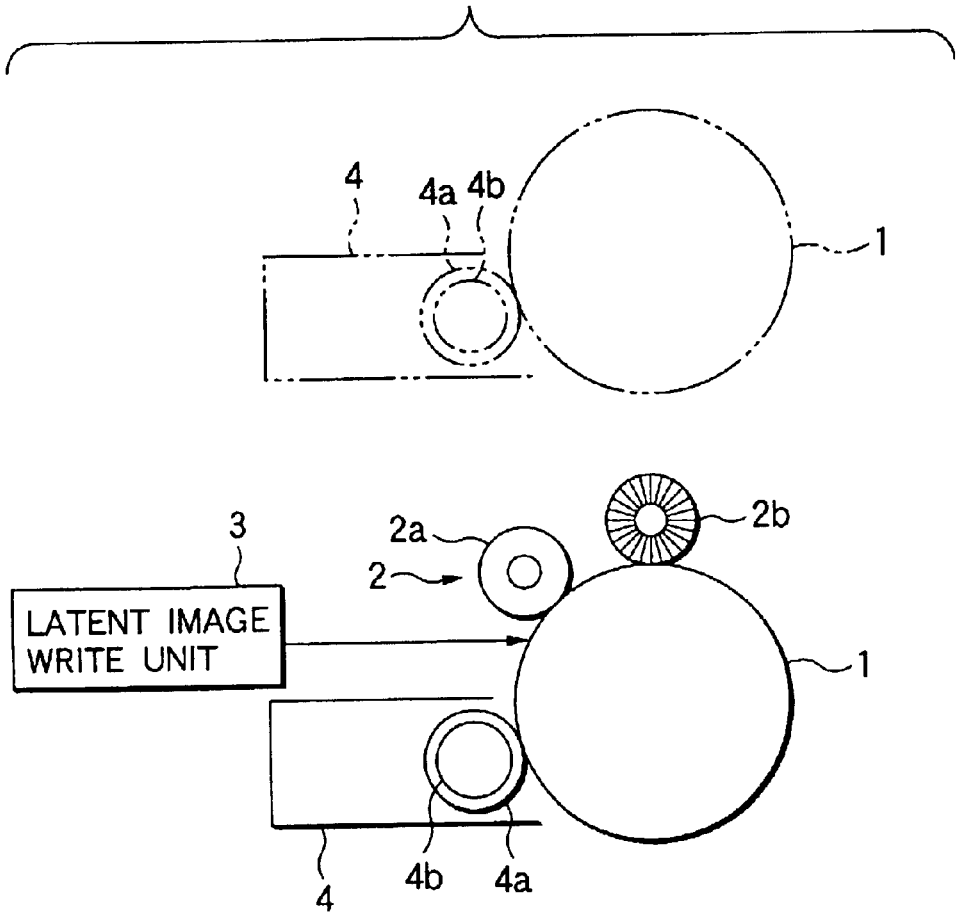
FIG. 22(*a*) is a schematic representation to show an outline of an image formation apparatus and a charger used therewith according to the invention and FIG. 22(*b*) is a schematic representation of the main part thereof.
Figure 22B:
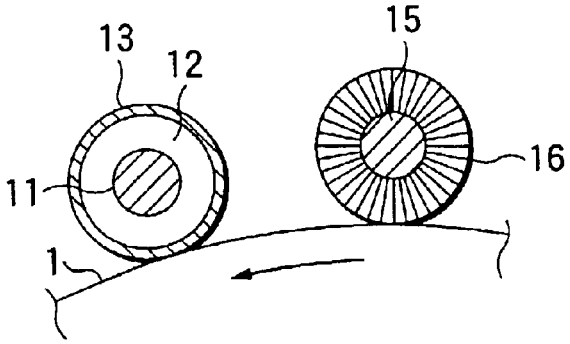

According to a third aspect of the invention, as shown in FIGS. 22(*a*) and 22(*b*), there is provided an image formation apparatus comprising an photoreceptor 1, a charger 2 having a charging member 2*a* placed in contact with or close to the photoreceptor 1, for charging the photoreceptor 1, a latent image write unit 3 for writing an electrostatic latent image onto the photoreceptor 1 charged by the charger 2, and a developing device 4 having at least a developer support 4*a* containing a magnetic field production member 4*b*, for rendering visible the electrostatic latent image written by the latent image write unit 3 with a developer, characterized in that at least an outermost peripheral surface of the charging member 2*a* of the charger 2 is coated with a surface layer film 13 formed of a polymeric material and the material of the surface layer film 13 has a Young's modulus of 0.6 GPa or less.

The charging member 2*a* is assumed to comprise at least the surface layer film 13.

The surface layer film 13 is a functional member required for keeping the surface smooth and making the charge property uniform, and is preferred in that the surface layer film 13 is easily electrostatically attracted to the photoreceptor 1 and nip uniformity is easily provided by an electrostatic attraction force.

Particularly, "the material of the surface layer film 13 has a Young's modulus of 0.6 GPa or less," whereby the contact property between the charging member 2*a* and the photoreceptor 1 is kept and the surface layer film 13 is urged to become deformed so as to envelop the carrier, so that spots are made unnoticeable and discharge gap is widely stabilized to prevent a charge ghost from occurring.

That is, the surface layer film 13 is sufficiently softened (the Young's modulus is lowered), so that the contact force with the photoreceptor 1 is good and if carrier exists between the surface layer film 13 and the photoreceptor 1, the surface layer film 13 becomes deformed so as to envelop the carrier. Thus, if a spot occurs, the size of the spot can be suppressed to a level not introducing any problem on practical use.

On the other hand, if the surface layer film 13 is softened, the surface layer film 13 is easily attracted to the photoreceptor 1 side and consequently, the curvature (curvature of the charging member 2*a* relative to the photoreceptor 1) of the prenip side (discharge area for charging the photoreceptor 1) lessens. Thus, it is estimated that the discharge area widens and the latent image history easily disappears to make a charge ghost hard to occur.

Next, preferably the material of the surface layer film 13 is a thermoplastic polyester elastomer.

This thermoplastic polyester elastomer has a Young's modulus of 0.2 GPa; in addition, a thermoplastic polyamide elastomer (0.6 GPa) or a thermoplastic fluorine resin elastomer (0.3 GPa) is available.

The surface layer film 13 has a thickness of 300 μm or less.

The purpose of setting the upper limit value to 300 μm is to keep the surface layer film 13 soft and provide nip uniformity.

Further, as the charging member 2*a*, any may be selected appropriately if the charging member 2*a* is a functional member for charging the photoreceptor 1; typically, as shown in FIG. 22(*b*), it is preferable that the charging member 2*a* may comprise a sponge-like conductive elastic body 12 on a support shaft 11 and an outer periphery of the conductive elastic body 12 may be coated with a cylindrical surface layer film 13.

In this case, the "sponge-like body" is preferred in that hardness can be lowered and a stable nip width can be taken to stabilize charging.

In this mode, a conductive urethane foam body is used as a representative example of the sponge-like conductive elastic body 12.

At this time, to provide conductivity, the urethane foam body may be impregnated with a conductive material, such as carbon black.

Further, the charger 2 basically comprise the charging member 2*a*, but the invention is not limited to this. For example, the following mode may be adopted:

According to the invention, as shown in FIG. 22, there is provided an image formation apparatus comprising a photoreceptor 1, a charger 2 having a charging member 2*a* placed in contact with or close to the photoreceptor 1, for charging the photoreceptor 1, a latent image write unit 3 for writing an electrostatic latent image onto the photoreceptor 1 charged by the charger 2, and a developing device 4 having at least a developer support 4*a* containing a magnetic field production member 4*b*, for rendering visible the electrostatic latent image written by the latent image write unit 3 with a developer, wherein the charger 2 has the charging member 2*a* and a removal member 2*b* being disposed in contact with the photoreceptor 1 in the upstream of the charging member 2*a*, the removal member 2*b* for removing a deposit on the photoreceptor 1 and wherein at least an outermost peripheral surface of the charging member 2*a* is coated with a cylindrical surface layer film 13 formed of a polymeric material and the material of the surface layer film 13 has a Young's modulus of 0.6 GPa or less.

That is, the charger 2 comprises "charging member 2*a*+removal member 2*b*."

In this mode in which the developing device 4 and the charger 2 are placed close to each other and the removal member 2*b* is disposed under the effect of a magnetic field produced by the magnetic field production member 4*b* of the developing device 4, preferably the removal member 2*b* is made of a magnetic material.

The third aspect of the invention is not limited to the image formation apparatus and is applied to the charger itself used with the image formation apparatus.

In this case, according to the third aspect of the invention, as shown in FIG. 22, there is provided a charger built in an image formation apparatus comprising a developing device 4 having at least a developer support 4*a* containing a magnetic field production member 4*b*, for rendering visible an electrostatic latent image on an photoreceptor 1 with a developer, the charger for charging the photoreceptor 1, characterized in that the charger 2 comprises a charging member 2*a* placed in contact with or close to the photoreceptor 1 and that at least an outermost peripheral surface of the charging member 2*a* is coated with a cylindrical surface layer film 13 formed of a polymeric material and the material of the surface layer film 13 has a Young's modulus of 0.6 GPa or less.

When the third aspect of the invention is applied to the charger 2 of the "charging member 2*a*+removal member 2*b*" type, as shown in FIG. 22, there is provided a charger built in an image formation apparatus comprising a developing device 4 having at least a developer support 4*a* containing a magnetic field production member 4*b*, for rendering visible an electrostatic latent image on an photoreceptor 1 with a developer, the charger for charging the photoreceptor 1, characterized in that the charger comprises a charging member 2*a* placed in contact with or close to the photoreceptor 1 and a removal member 2*b* disposed in contact with the photoreceptor 1 in the upstream of the charging member 2*a*, the removal member 2*b* for removing a deposit on the photoreceptor 1 and that at least an outermost peripheral surface of the charging member 2*a* is coated with a cylindrical surface layer film 13 formed of a polymeric material and the material of the surface layer film 13 has a Young's modulus of 0.6 GPa or less.

It is noted that each mode preferred in one aspect of the invention may be applied to any other aspect of the invention without departing from the spirit and the scope of each aspect of the invention.

DETAILED DESCRIPTION OF THE PREFERRED EMBODIMENTS

Referring now to the accompanying drawings, there are shown preferred embodiments of the invention.

First Embodiment

Figure 2:
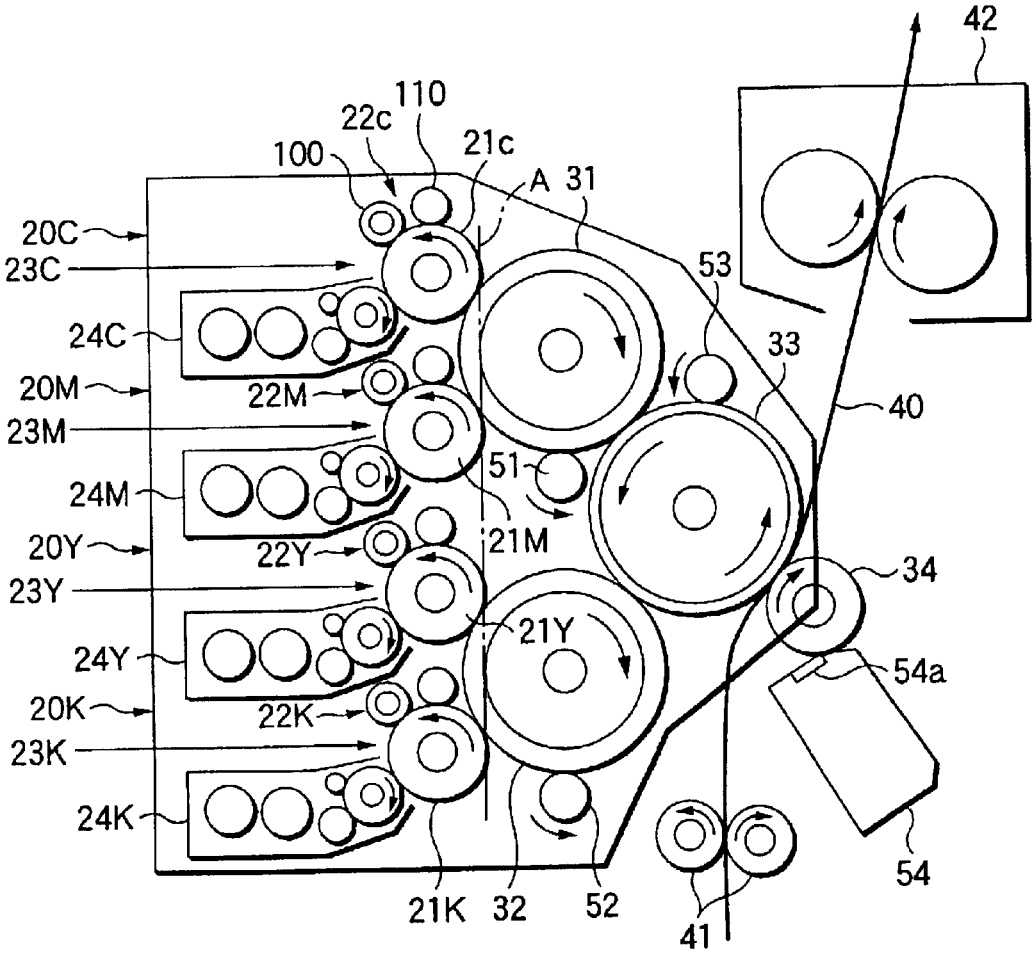
FIG. 2 is a schematic representation to show the general configuration of an image formation apparatus according to of a first embodiment to which the invention is applied.

FIG. 2 shows a first embodiment of an image formation apparatus incorporating the invention (in this example, a full-color printer). Each arrow in FIG. 2 indicates rotation direction of each rotation member.

As shown in FIG. 2, the full-color printer has a main section made up of image formation units 20 (20Y, 20M, 20C, and 20K) having photoconductor drums 21 (21Y, 21M, 21C, and 21K) for yellow (Y), magenta (M), cyan (C), and black (K), chargers 22 for primary charging (22Y, 22M, 22C, and 22K) coming in contact with the photoconductor drums 21, a light exposure unit such as a laser optical unit (not shown) for applying laser light beams 23 (23Y, 23M, 23C, and 23K) of yellow (Y), magenta (M), cyan (C), and black (K), developing devices 24 (24Y, 24M, 24C, and 24K) storing developers containing color component toners, a first primary intermediate transfer drum 31 coming in contact with the two photoconductor drums 21C and 21M of the four photoconductor drums 21, a second primary intermediate transfer drum 32 coming in contact with other two photoconductor drums 21Y and 21K, a secondary intermediate transfer drum 33 coming in contact with the first and second primary intermediate transfer drums 31 and 32, and a final transfer roll 34 coming in contact with the secondary intermediate transfer drum 33.

The photoconductor drums 21 are spaced from each other at constant intervals so as to have a common contact plane U. The first and second primary intermediate transfer drums 31 and 32 are placed so that rotation axes thereof are parallel to the photoconductor drum 21 axes and are symmetrical with the photoconductor drum 21 axes with respect to a predetermined symmetrical plane as a boundary. Further, the secondary intermediate transfer drum 33 is placed so that rotation axis thereof is parallel to the photoconductor drum 21 axes.

A signal responsive to image information for each color is rasterized by an image processing unit (not shown) and is input to the laser optical unit (not shown). In the laser optical unit, the laser light beam 23Y, laser light beam 23M, laser light beam 23C, and laser light beam 23K are modulated and are applied to the photoconductor drums 21Y, 21M, 21C, and 21K of the corresponding colors.

An image formation process for each color based on known electrophotography is performed in the surroundings of each of photoconductor drums 21.

First, a photoconductor drum using an OPC photoconductor having a predetermined diameter (for example, 20 mm) is used as each of the photoconductor drums 21 and the photoconductor drums 21 are driven and rotated at the rotation speed of predetermined process speed (for example, 95 mm/sec).

As shown in FIG. 2, a DC voltage at a predetermined charging level (for example, about −800 V) is applied to each charger 22, whereby the surface of the corresponding photoconductor drum 21 is uniformly charged to a predetermined level. In the embodiment, only DC voltage is applied to the chargers 22, but an AC component may also be superposed on a DC component.

The laser optical unit as the light exposure unit applies the laser light beam 23Y, laser light beam 23M, laser light beam 23C, and laser light beam 23K to the surfaces of the photoconductor drums each thus comprising a uniform surface potential to form electrostatic latent images responsive to the input image information for each color. The laser optical unit writes the electrostatic latent images, whereby the surface potential of the image exposure part on each of the photoconductor drums 21 is erased to a predetermined level (for example, about −60 V or less).

The electrostatic latent image corresponding to each color formed on the surface of each of the photoconductor drums 21 is developed by the developing device 24 of the corresponding color and is rendered visible as a toner image of the corresponding color on the corresponding photoconductor drum 21.

Next, the toner images of the colors formed on the photoconductor drums 21 are electrostatically primarily transferred onto the first and second primary intermediate transfer drums 31 and 32. The yellow (Y) and magenta (M) toner images formed on the photoconductor drums 21Y and 21M are transferred onto the first primary intermediate transfer drum 31 and the cyan (C) and black (K) toner images formed on the photoconductor drums 21C and 21K are transferred onto the second primary intermediate transfer drum 32.

After this, the single-color or dual-color toner images formed on the first, second primary intermediate transfer drums 31, 32 are electrostatically secondarily transferred onto the secondary intermediate transfer drum 33.

Therefore, the final toner image from a single-color image to a quadruple-color image of yellow (Y), magenta (M), cyan (C), and black (K) is formed on the secondary intermediate transfer drum 33.

Last, the final toner image from a single-color image to a quadruple-color image of yellow (Y), magenta (M), cyan (C), and black (K) formed on the secondary intermediate transfer drum 33 is tertiarily transferred to paper passing through a paper transport passage 40 by the final transfer roll 34. The paper undergoes a paper feed step (not shown), passes through a paper transport roll 41, and is sent into a nip part between the secondary intermediate transfer drum 33 and the final transfer roll 34. After the final transfer step, the final transfer image formed on the paper is fixed by a fuser 42 and the image formation process sequence is now complete.

In the embodiment, although described later in detail, each charger 22 comprises a charging roll 100 for charging the corresponding photoconductor drum 21 and a brush roll 110 as a refresher in the upstream of the charging roll 100, as shown in FIG. 2, so that foreign substance (remaining toner, carrier, etc.,) on the corresponding photoconductor drum 21 is removed with the brush roll 110 to prevent the foreign substance on the photoconductor drum 21 from being moved to the charging roll 100 side.

Primary intermediate brush rolls 51 and 52 and a secondary intermediate brush roll 53 are placed in contact with the primary intermediate transfer drums 31 and 32 and the secondary intermediate transfer drum 33 as refreshers for temporarily holding the foreign substances (remaining toner, carrier, etc.,) on the surfaces of the corresponding drums 31, 32, and 33.

Further, the final transfer roll 34 is provided with a cleaning device 54 (54*a*: Blade) adopting a blade cleaning way, for example.

Next, the developing devices 24 and the chargers 22 used with the embodiment will be discussed.

To begin with, the developing devices 24 will be discussed.

Figure 3:
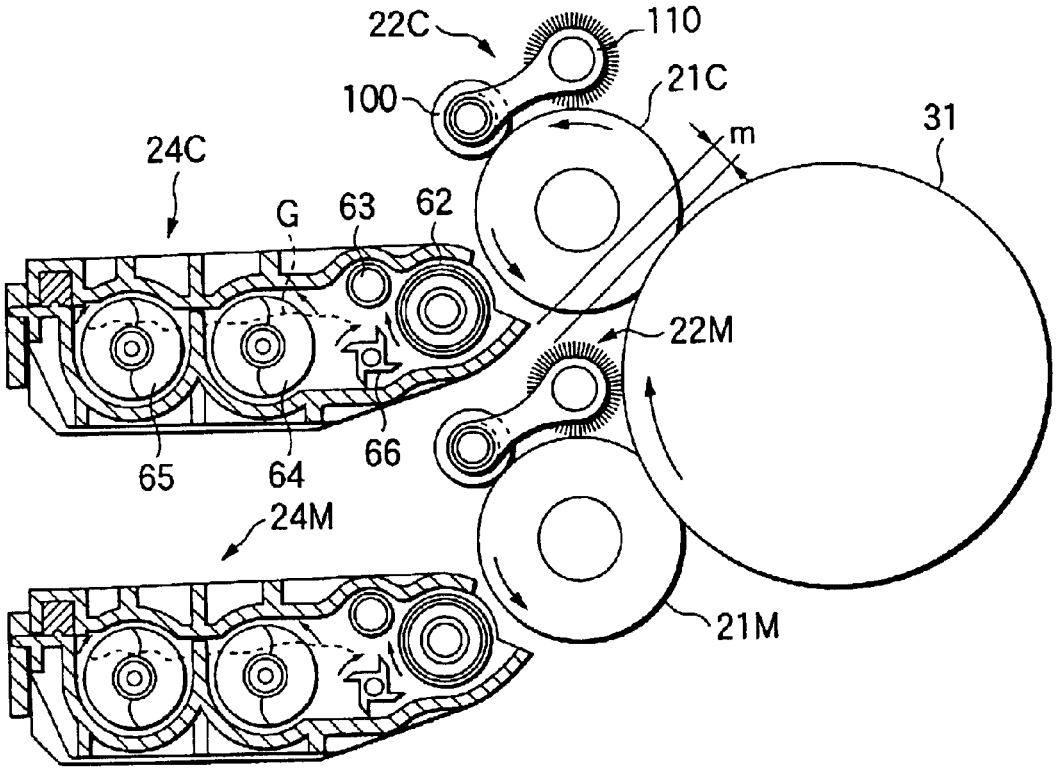
FIG. 3 is a schematic representation of the main part of the image formation apparatus according to the first embodiment of the invention.
Figure 4:
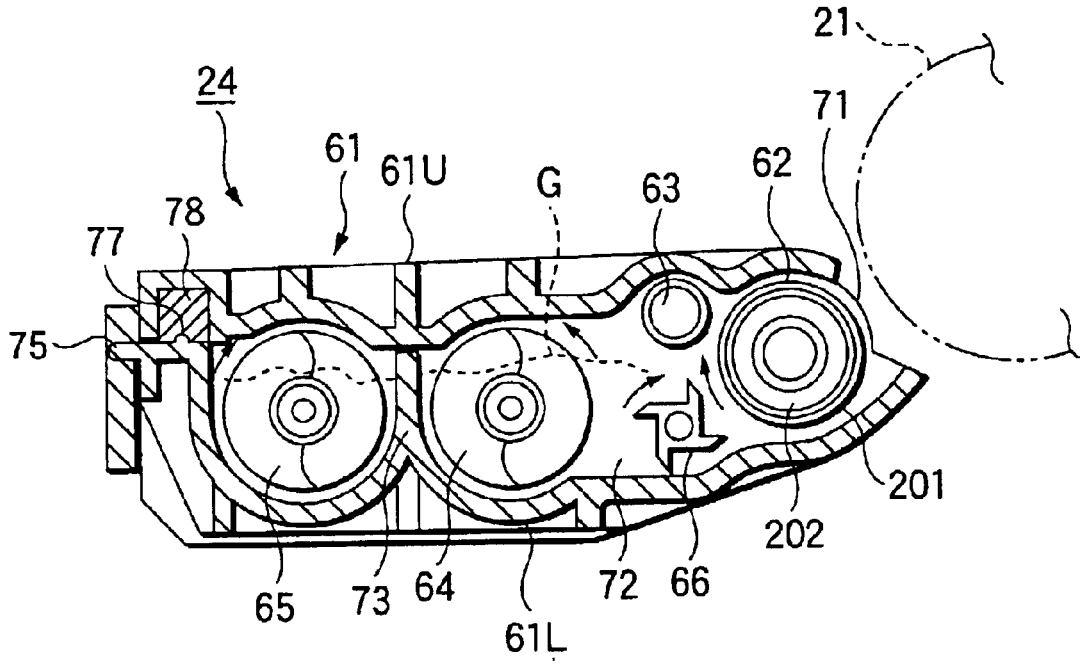
FIG. 4 is a cross-sectional schematic representation to show a developing device according to the first embodiment of the invention.

In the embodiment, a plurality of developing devices 24 are disposed in a vertical direction, for example, as shown in FIG. 3 and the developing device 24C, for example, is placed close to the charger 22 of the image formation unit 20 (for example, 20M) on the lower side with a gap m (for example, about 2 to 5 mm).

The basic configuration of each developing device 24 will be discussed below:

The developing device 24 basically has a main section made up of a housing 61 as a cabinet, a developing roll 62 as a developer support, a layer thickness regulation roll 63 as a layer thickness regulation member, two augers 64 and 65 as developer agitation and transport members, and a paddle wheel 66 as a developer supply member, as shown in FIGS. 3 to 6.

In the figure, numeral 21 denotes the photoconductor drum as an photoreceptor on which an electrostatic latent image responsive to image information is formed, G denotes a developer comprising nonmagnetic toner and magnetic carrier, and each arrow indicates the rotation direction of each rotating part. The developer G may be a dual-component developer.

In the embodiment, the housing 61 is shaped like an elongated box which is thinly flat like a plate on the whole and has a structure wherein an opening part 71 disposed to expose a part of the developing roll 62 is defined in a part as an end part opposed to the photoconductor drum 21 and a developer storage section 72 for storing the developer G is formed in a part to an opposite end to the opening part 71.

The developer storage section 72 is formed with two parallel developer circulation transport passages communicating with each other at both end parts and separated by a partition wall 73 at the center thereof.

The housing 61 is of a structure wherein a lower housing 61L and an upper housing 61U into which the housing 61 is divided in an up and down direction are joined and assembled. The housing 61 has a thickness (full height in the up and down direction) of about 30 mm.

In the figure, numeral 75 denotes a plurality of engaging protrusions formed on a rear joint face portion of the lower housing 61L and numeral 76 denotes a plurality of engaging holes defined in a rear joint face portion of the upper housing 61U into which the plurality of engaging protrusions 75 on the lower housing 61L are inserted when the lower housing 61L and the upper housing 61U are joined and assembled. Numeral 77 denotes a rib having a protrusion and numeral 78 denotes an elastic seal member for the housing joint part.

Figure 5:
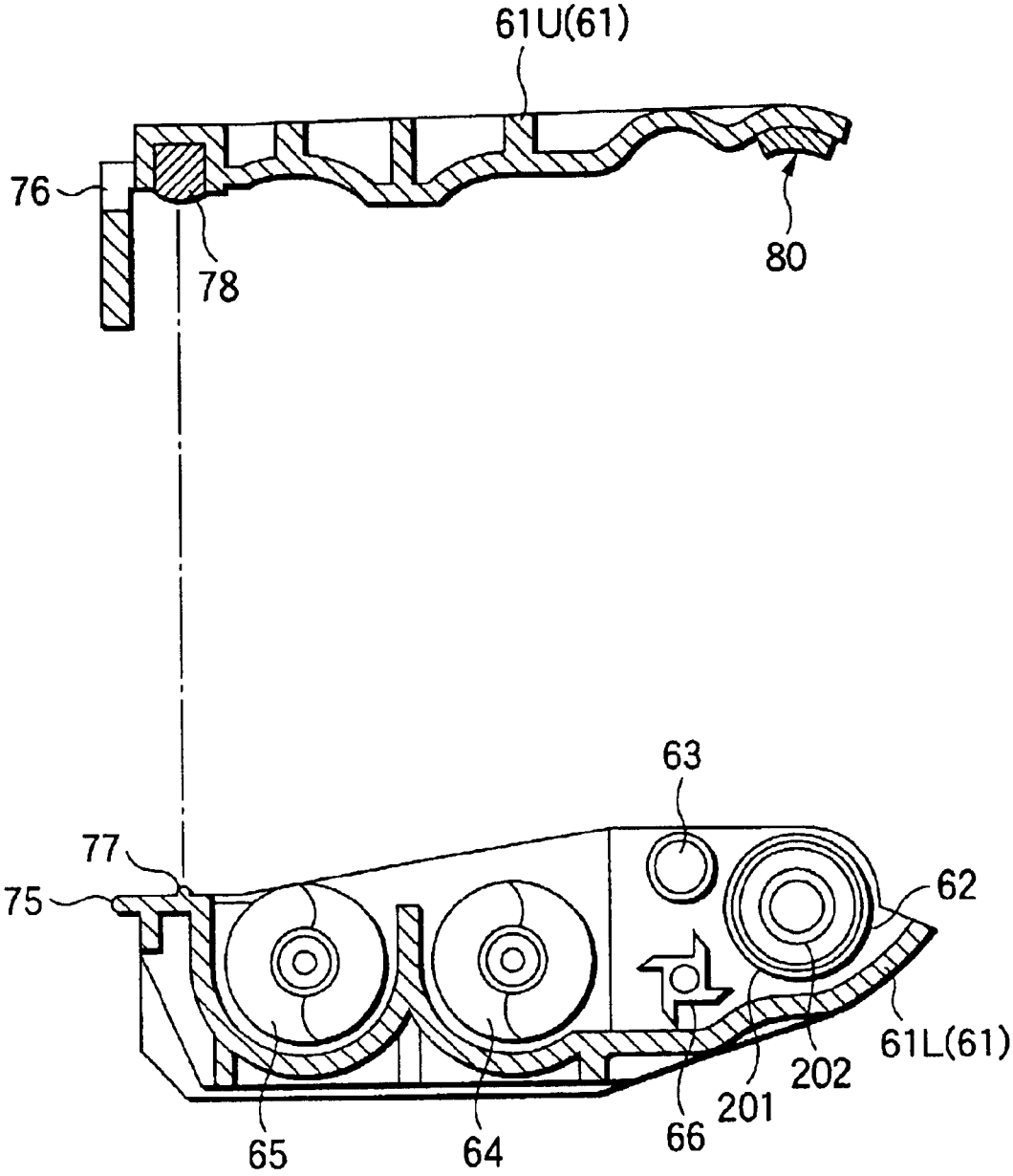
FIG. 5 is a schematic representation to show a state in which an upper housing of the developing device according to the first embodiment of the invention is removed.
Figure 6:
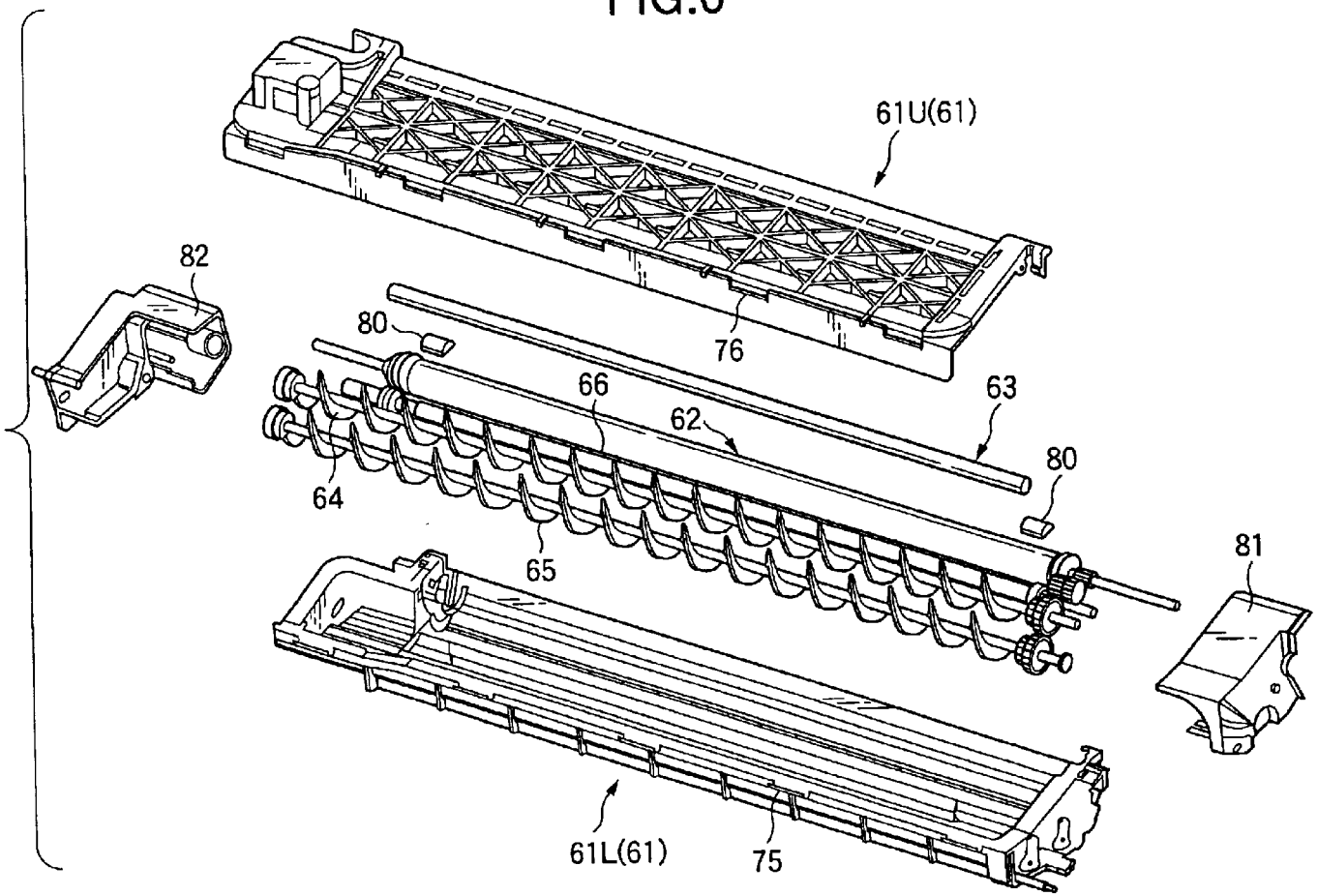
FIG. 6 is an exploded perspective view of the developing device according to the first embodiment of the invention.

Further, in FIG. 5 or 6, numeral 80 denotes a regulation block (thin layer area regulation member) being placed above the end part of the developing roll 62 for regulating a thin layer area regulation position on the developing roll 62 from a side although described later in detail; in the embodiment, the regulation block 80 is attached to the upper housing 61U (see FIGS. 5 and 6)

Further, numerals 81 and 82 denote side brackets for holding both ends of the housing 61 and installing the developing device 24 in the main unit of the image formation apparatus.

The developing roll 62 comprises a nonmagnetic sleeve 201 shaped like a hollow cylinder disposed to be rotatable in the vicinity of the opening part 71 of the housing 61 and a magnet roll 202 comprising a plurality of magnetic poles placed at a predetermined angle in the hollow of the sleeve 201, the sleeve 201 and the magnet roll 202 fixed positions thereof.

Figure 7:
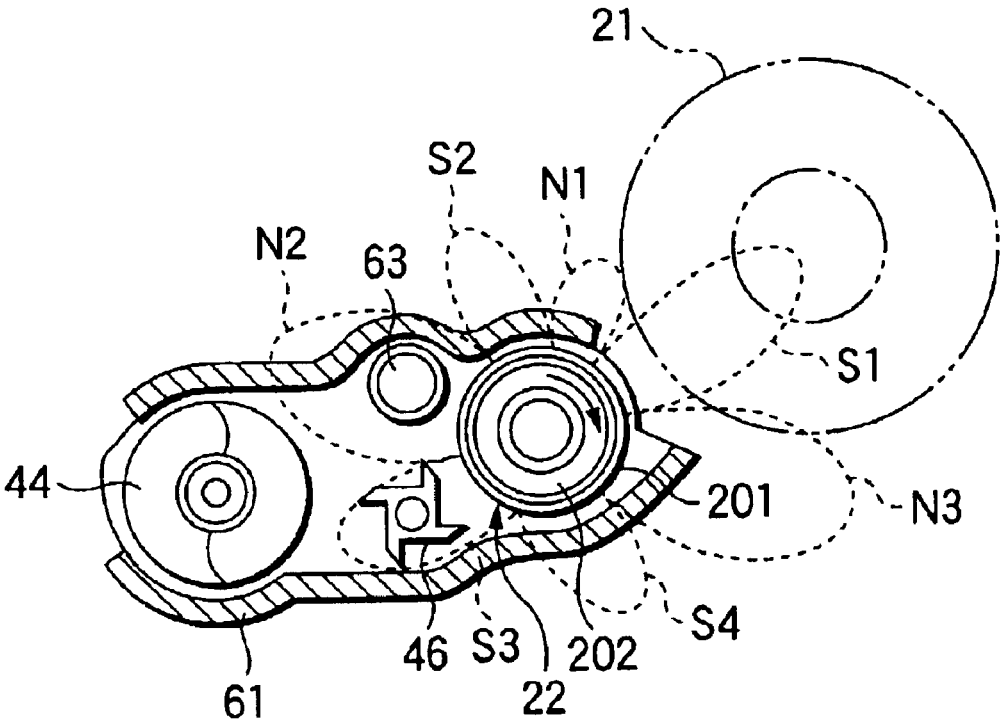
FIG. 7 is a schematic representation to show a magnetic force pattern of the developing device according to the first embodiment of the invention.

In the example, the developing roll 62 has a small outer diameter (the outer diameter of the sleeve 201) of about 12 mmϕ, for example. As shown in FIG. 7, the magnet roll 202 comprises seven magnetic poles of S1, S2, S3, S4, N1, N2, and N3 appropriately placed to become each magnetic flux distribution of the S pole or the N pole (indicated by a dotted line in FIG. 7) relative to the roll axis.

The magnetic pole S1 is a developing magnetic pole, the magnetic poles S3 and S4 are repulsion magnetic poles for peeling off the developer, the magnetic pole N2 is a magnetic pole for regulating the layer thickness, and other magnetic poles function as transport magnetic poles in conjunction with the adjacent magnetic pole.

Further, the layer thickness regulation roll 63, which is a nonmagnetic roll, is disposed to face the surface of the developing roll 62 (sleeve 201) with a gap held for regulating the layer thickness of the developer G supported on the surface of the developing roll 62 (sleeve 201) to a predetermined thickness. The layer thickness regulation roll 63 uses a solid stainless roll, for example, 5 mm in diameter and is placed, for example, with a spacing of about 250 $\mu$m from the developing roll 62. Both end parts of the layer thickness regulation roll 63 are dropped into an attachment groove formed in the proximity of the developing roll 62 on a side wall of the lower housing 61L and when the housing 61 is assembled, the layer thickness regulation roll 63 is pushed from above by a part of the upper housing 61U, whereby the layer thickness regulation roll 63 is pressed into the attachment groove finally and is fixed formally.

Further, the augers 64 and 65 are each a rotation member comprising an impeller section wound around a rotation shaft section spirally at predetermined pitches, for agitating and charging the developer G and are disposed so as to rotate in the two developer circulation transport passages in the developer storage section 72 of the housing 61. The augers 64 and 65 have each an outer diameter of about 13 mm.

The paddle wheel 66 is a rotation member shaped like an impeller wheel comprising a rotation shaft section formed with, for example, four impeller parts moved in parallel (offset) downstream in the shaft rotation direction and is disposed so as to rotate at a position between the developing roll 62 and the auger 64.

Particularly, the embodiment is characterized by an end part peripheral configuration of the developing roll 62, specifically setting way of the thin layer area regulation position regulated by the regulation block 80.

Figure 8A:
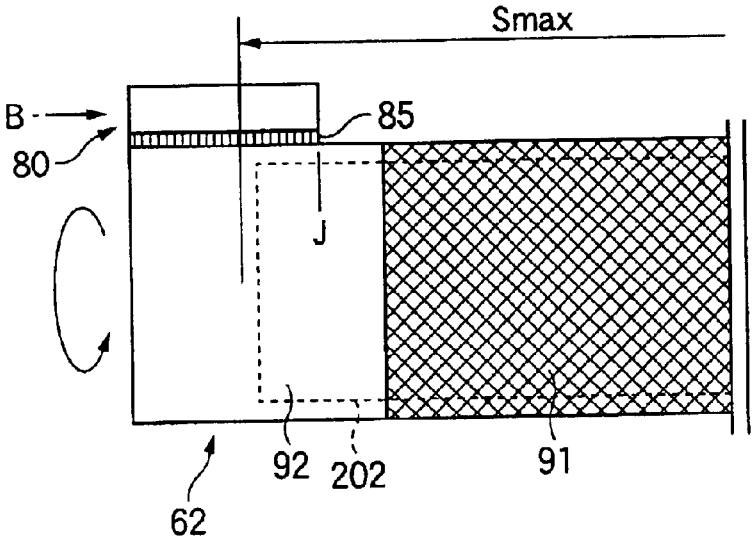
FIG. 8(*a*) is a schematic representation to show the configuration in the vicinity of an developing roll end part of the developing device according to the first embodiment of the invention and FIG. 8(*b*) is a view from the B direction in FIG. 8(*a*).
Figure 8B:
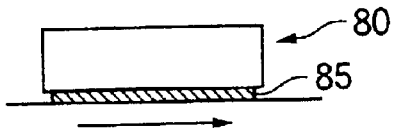

That is, as shown in FIG. 8(*a*), a rough surface work part 91 is placed on the surface of the sleeve 201 of the developing roll 62.

Sand blast work, shot blast work, grinding work, or the like may be selected appropriately for the rough surface work part 91; however, preferably the sand blast method with spherical abrasive grains is adopted from the viewpoint of providing uniformity of rough surface work.

The formation area of the rough surface work part 91 may extend over the range in which a thin layer area of a developer needs to be formed as a rough surface to such an extent that a transport force is given to the developer.

Therefore, in the example, the rough surface work part 91 is formed on the peripheral surface except for the end parts of the developing roll 62 and a non-rough surface work part 92 remains at both the end parts.

The non-rough surface work part 92 may be subjected to no rough surface work; however, preferably it is treated so as to decrease the surface roughness as much as possible.

At this time, preferably the non-rough surface work part 92 is coated with a resin or is worked on so as to lessen the friction coefficient (for example, grinding work).

From the viewpoint of keeping the good triboelectrification property of toner, to coat the non-rough surface work part 92 with a resin, preferably the resin is selected from such a triboelectric series of urging the charge amount of the toner by triboelectrification with the toner or a resin for preventing the charge amount of the toner from being lowered on contact with the toner is selected and further the resin-coated layer is provided with surface resistance of $10^{13}$ Ω/□ or more so that toner charges are not dissipated unnecessarily.

In the embodiment, a thin layer area regulation position J regulated by the regulation block 80 is set outside the end of the rough surface work part 91 and the non-rough surface work part 92 always exists between the thin layer area regulation position J and the end of the rough surface work part 91.

Further, in the embodiment, the thin layer area regulation position J regulated by the regulation block 80 is set inside an end in a width direction orthogonal to a traveling direction of paper of the maximum use size.

Since a margin area outside an image area usually exists in the edge portion periphery of paper, the preferred positional relationships among the members are embodied in the margin area.

In FIG. 8(*a*), Smax denotes the dimension of paper of the maximum use size in the width direction thereof.

Further, in the embodiment, the end in the width direction of the developing magnetic pole (S1: See FIG. 7) of the magnet roll 202 in the developing roll 62 is set the same as or inside the end in the width direction of paper of the maximum use size and the thin layer area regulation position J regulated by the regulation block 80 is set inside the end in the width direction of the developing magnetic pole.

Accordingly, transverse displacement of the developer G at the end part of the developing magnetic pole is prevented.

The regulation block 80 is placed in contact with a part of the end part of the developing roll 62, for example, an upper face part of the end part of the developing roll 62 to regulate the thin layer area of the developer G.

Preferably, the sliding resistance between the regulation block 80 and the end part of the developing roll 62 is decreased as much as possible from the viewpoint of stabilizing the rotation operation of the developing roll 62.

In the example, the regulation block 80 is provided with brush bristles 85 put on a part facing the end part of the developing roll 62 to press the brush bristles 85 against the end part of the developing roll 62, for example, as shown in FIGS. 8(*a*) and (*b*), whereby the torque with the developing roll 62 is more decreased.

Figure 9A:
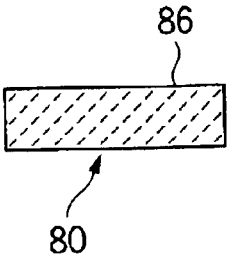
FIGS. 9(*a*) to 9(*c*) are schematic representations to show modifications of thin layer area regulation members used in the first embodiment of the invention.
Figure 9B:
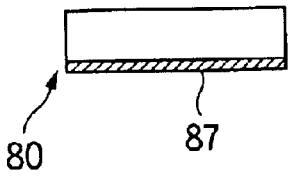
Figure 9C:
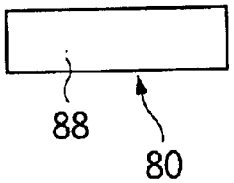

As a modification of the regulation block 80, the regulation block 80 may be provided with felt 86 with low resistance fully or at a part facing the end part of the developing roll 62 to press the felt 86 against the end part of the developing roll 62, for example, as shown in FIG. 9(*a*), may be provided with a low-friction part 87 with small frictional resistance, such as a fluorine resin work part such as Teflon to bring the low-friction part 87 into contact with the end part of the developing roll 62, for example, as shown in FIG. 9(*b*), or may be formed of a polyolefin family resin 88 with small frictional resistance to bring the resin surface itself into contact with the end part of the developing roll 62, for example, as shown in FIG. 9(*c*).

Next, a layer formation state of the developer G in the edge portion periphery of the developing roll 62 is shown.

According to the model of the embodiment, the developer G is transported on the rough surface work part 91 of the developing roll 62 and if the developer layer thickness attempts to increase at the end part of the rough surface work part 91, it is not immediately regulatedby the regulation block 80 and thus an incremental portion of the developer layer thickness is leveled in a space between the rough surface work part 91 and the regulation block 80.

Particularly, if the surface roughness of the non-rough surface work part 92 is made sufficiently small, the non-rough surface work part 92 becomes a low-friction part, the transport force of the developer G on the non-rough surface work part 92 becomes very small as compared with that on the rough surface work part 91, and the holding force of the developer G is minimized. Thus, the developer layer thickness on the non-rough surface work part 92 between the rough surface work part 91 and the regulation block 80 becomes smaller than the developer layer thickness on the rough surface work part 91 and the detrimental effect of increasing the developer layer thickness at the end part of the developing roll 62 and improper jetting of toner is hard to occur.

Figure 10A:
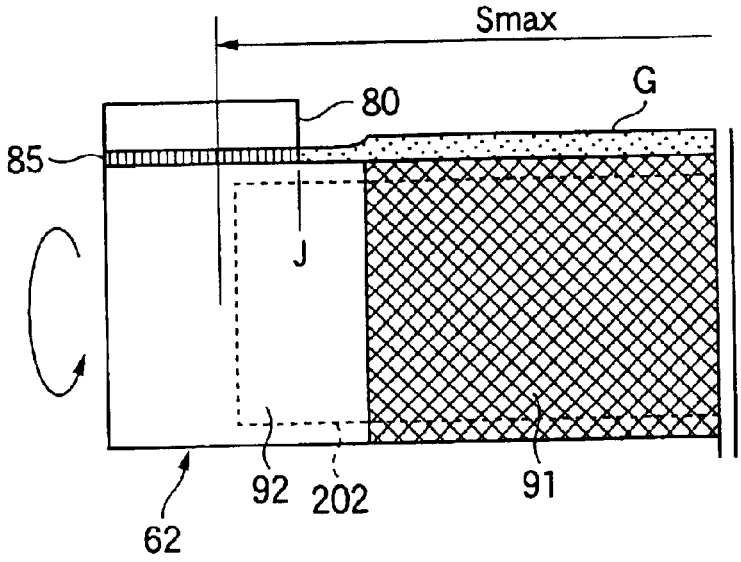
FIG. 10(*a*) is a schematic representation to show the thin layer formation state of a developer according to the first embodiment of the invention and FIG. 10(*b*) is a schematic representation to show the thin layer formation state of a developer according to a comparative example.
Figure 10B:
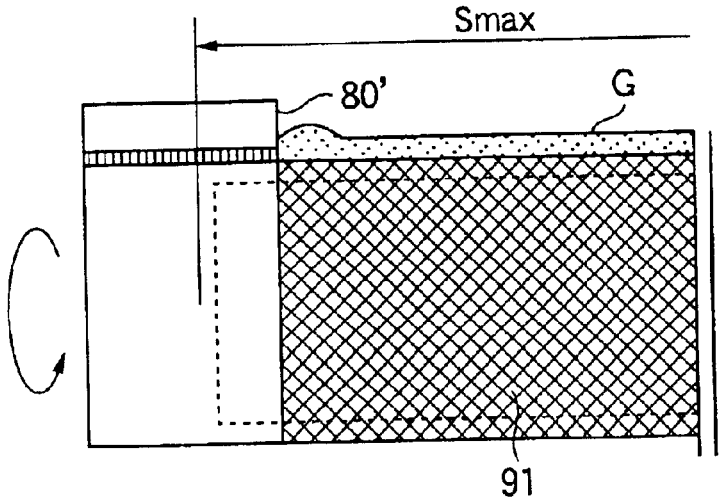

In a comparative model as shown in FIG. 10(*b*), for example, a regulation block 80' is set adjacent to the rough surface work part 91 of the developing roll 62; in the model, unlike the model of the embodiment, the space of the non-rough surface work part 92 is not provided between the rough surface work part 91 and the regulation block 80 and thus if the developer layer thickness attempts to increase at the end part of the rough surface work part 91, no space for absorbing it exists, it is immediately blocked by the regulation block 80', and the detrimental effect of increasing the developer layer thickness at the end part of the developing roll 62 and improper jetting of toner easily occurs.

Figure 11A:
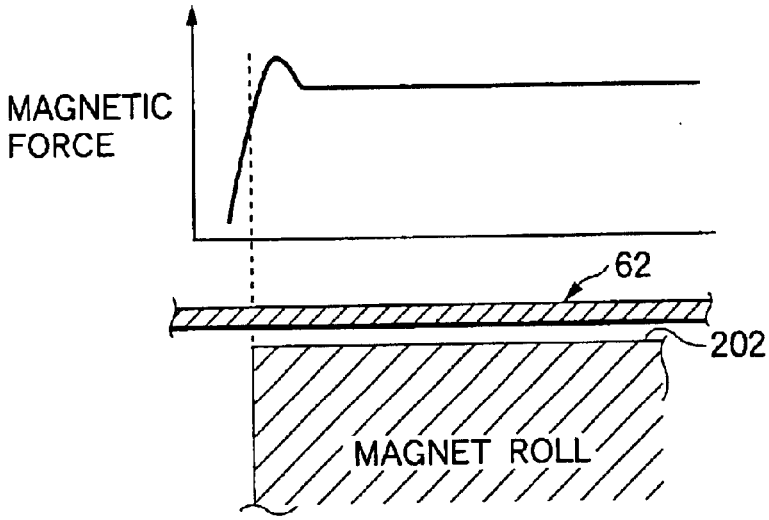
FIG. 11(*a*) is a schematic representation to show a magnetic force distribution in the vicinity of an end part of a magnet roll in a comparative example 1 and FIG. 11(*b*) is a schematic representation to show the thin layer formation state of the developer in the vicinity of the end part of the magnet roll in the comparative example 1.
Figure 11B:
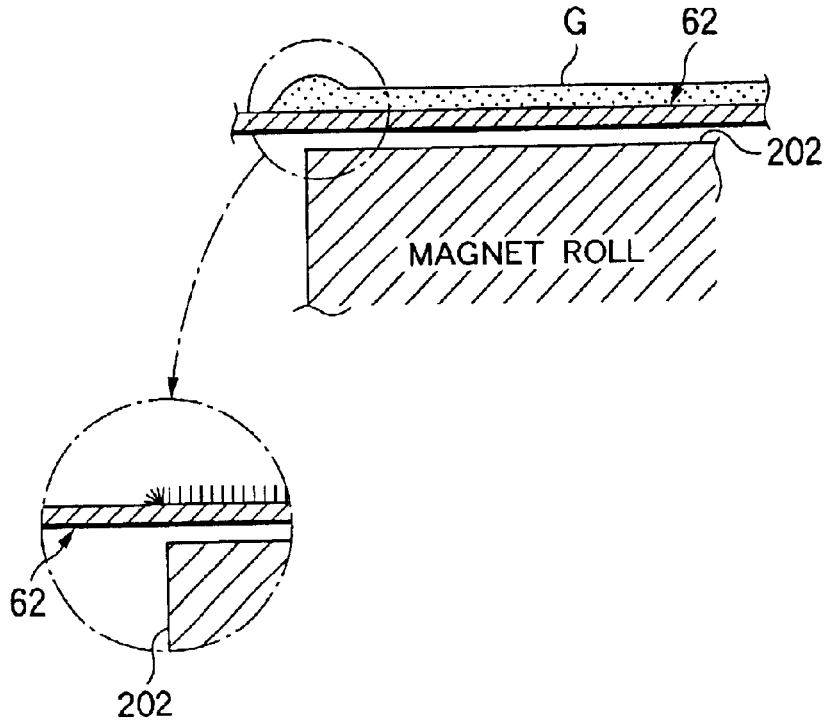

In the embodiment, the thin layer area regulation position J of the regulation block 80 is set inside the end in the width direction of the developing magnetic pole of the magnet roll 202, as shown in FIG. 10(*a*) and thus a transverse displacement phenomenon of the developer G at the end part of the magnet roll 202 does not occur, as shown in FIGS. 11(*a*) and (*b*).

That is, as shown in FIG. 11(*a*), examining the magnetic force distribution of the magnet roll 202, it is understood that the magnetic force lowers gradually from the end part position of the magnet roll 202 to the outside.

Thus, assuming that the thin layer area regulation area extends to the vicinity of the end part of the magnet roll 202, as shown in FIG. 11(*b*), as the developer layer swells in thickness at the end part of the magnet roll 202 and moreover ears of the developer G at the end part of the magnet roll 202 fall down in the transverse direction, a phenomenon in which the developer G tumbles, scatters, and displaces transversely with rotation of the developing roll 62 can occur.

However, in the embodiment, the thin layer area regulation position J regulated by the regulation block 80 is set inside the end in the width direction of the magnet roll 202 (at least the developing magnetic pole) and thus the swelling and transverse displacement phenomenon of the developer G at the end part of the magnet roll 202 (at least the developing magnetic pole) as described above does not occur in the vicinity of the thin layer area regulation position J regulated by the regulation block 80.

Thus, the accident in which the developer G swells locally in the vicinity of the regulation block 80 because the developer G swells and transversely displaces by the magnetic force at the end part of the magnet roll 202 can be avoided effectively.

In the embodiment, the non-rough surface work part 92 is provided at the end part of the developing roll 62, but the invention is not necessarily limited to this. For example, the developing roll 62 may be provided with a level difference part 93 with a small outer diameter in the vicinity of the regulation block 80 as compared with the rough center of the thin layer area regulation area and the level difference position of the level difference part 93 may be set inside the thin layer area regulation position J and inside the end in the width direction of paper of the maximum use size as shown in FIG. 12(*a*), or the developing roll 62 may be provided with a taper part 94 with a gradually reduced outer diameter in the vicinity of the regulation block 80 as compared with the rough center of the thin layer area regulation area and the start position of the taper part 94 may be set inside the thin layer area regulation position J and inside the end in the width direction of paper of the maximum use size as shown in FIG. 12(*b*).

Figure 12A:
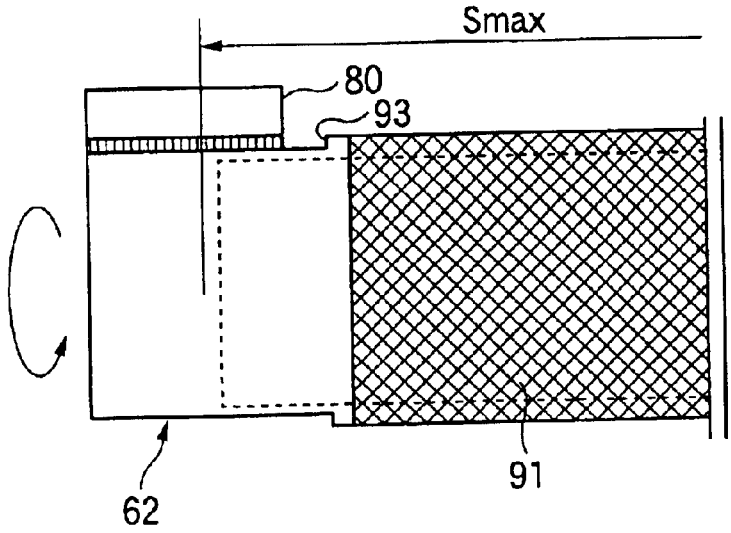
FIGS. 12(*a*) and 12(*b*) are schematic representations to show modifications in the vicinity of an end part of a developing roll used in the first embodiment of the invention.
Figure 12B:
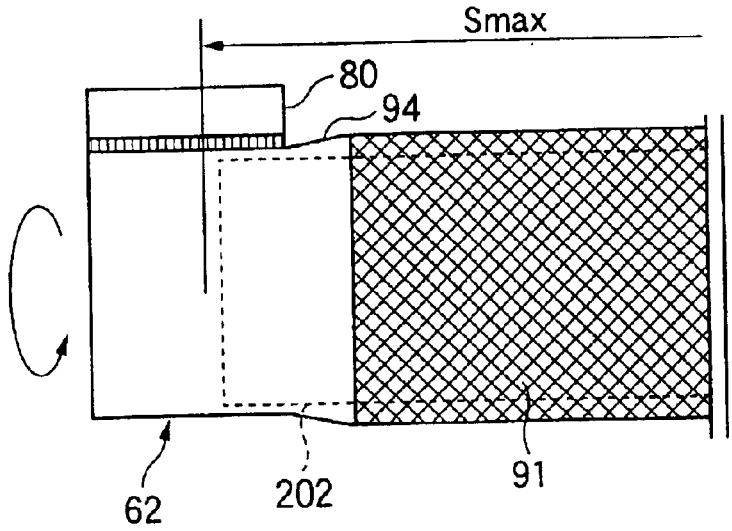

According to the mode (FIG. 12(*a*) or (*b*)), if the developer layer thickness attempts to increase at the end part of the rough surface work part 91, it is made possible to absorb the incremental portion in the space of the cut portion of the level difference part 93 or the taper part 94, and the layer thickness increase phenomenon of the developer G at the end part of the developing roll 62 can be suppressed effectively.

Next, the charger of the embodiment will be discussed in detail.

Figure 13:
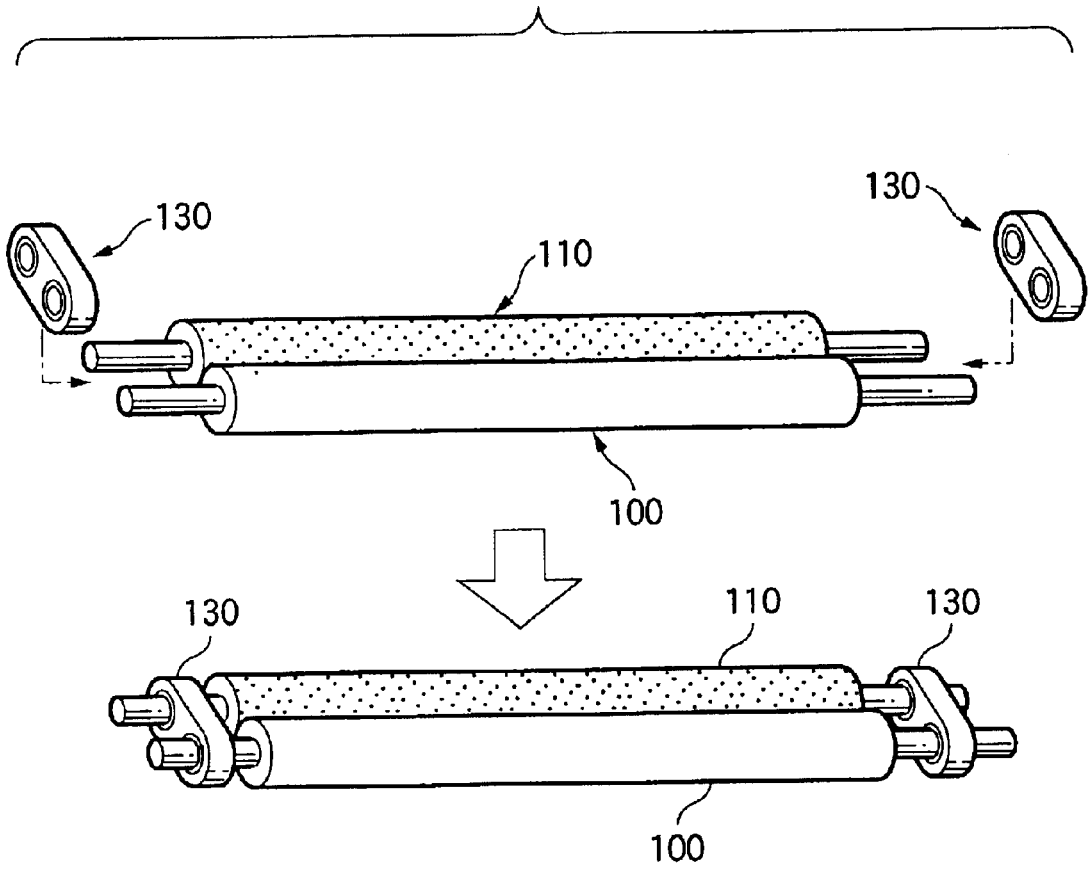
FIG. 13 is a schematic representation to show an attachment structure of a charger according to the first embodiment of the invention.

In the embodiment, as shown in FIG. 13, the charger 22 comprises the charging roll 100 for charging the photoconductor drum 21 and the brush roll 110 as a refresher in the upstream of the charging roll 100 which are supported to be rotatable by a pair of bearing members 130.

Figure 14A:
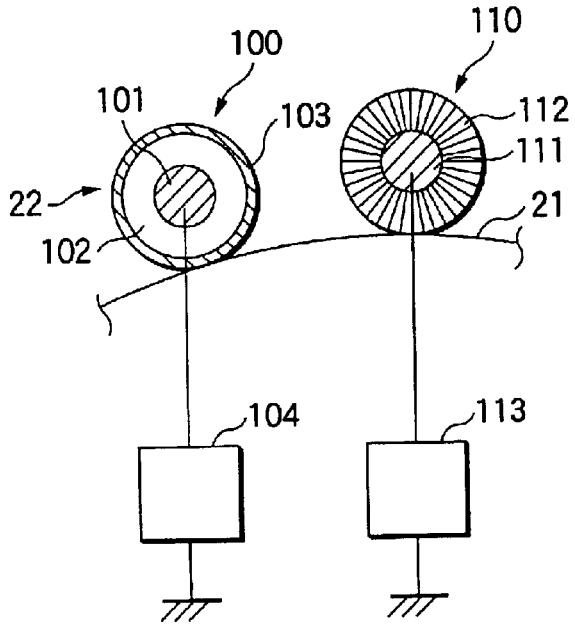
FIG. 14(*a*) is a schematic representation to show the details of the charger according to the first embodiment of the invention, FIG. 14(*b*) is a schematic representation to show the operation state in an image formation mode of the charger, and FIG. 14(*c*) is a schematic representation to show the operation state in a cleaning mode of the charger.
Figure 14B:
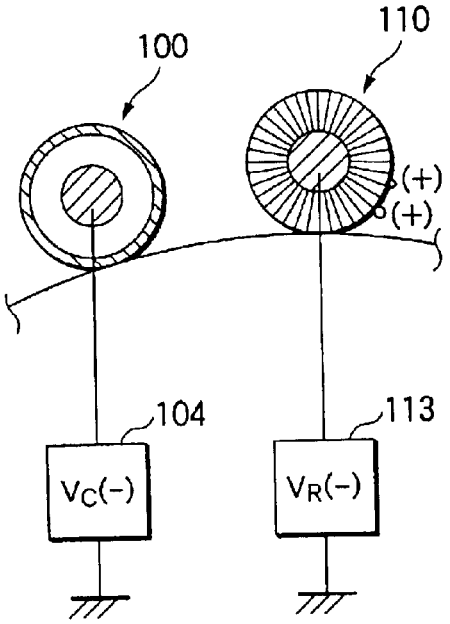
Figure 14C:
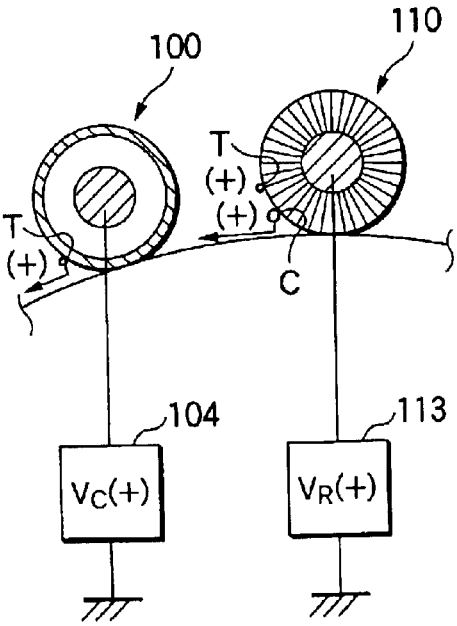
Figure 19:
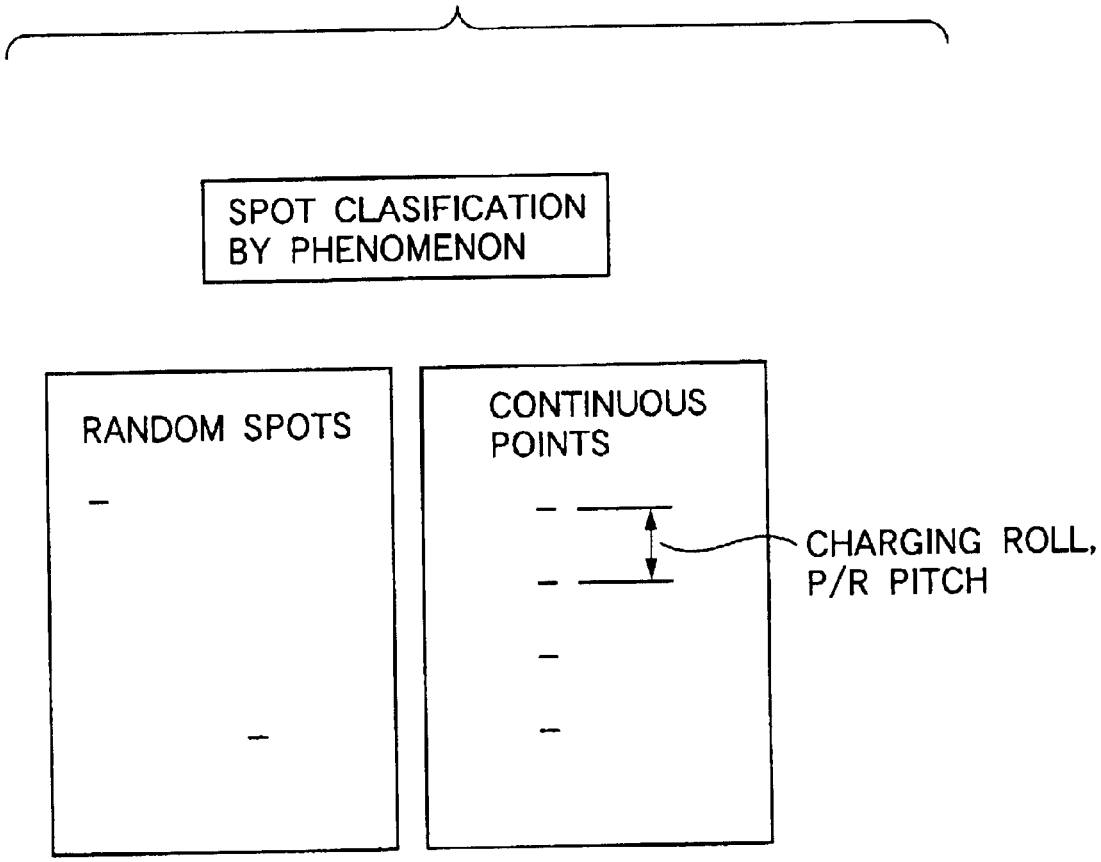
FIG. 19 is a schematic representation to show a technical problem of an image formation apparatus according to a related art.
Figure 20:
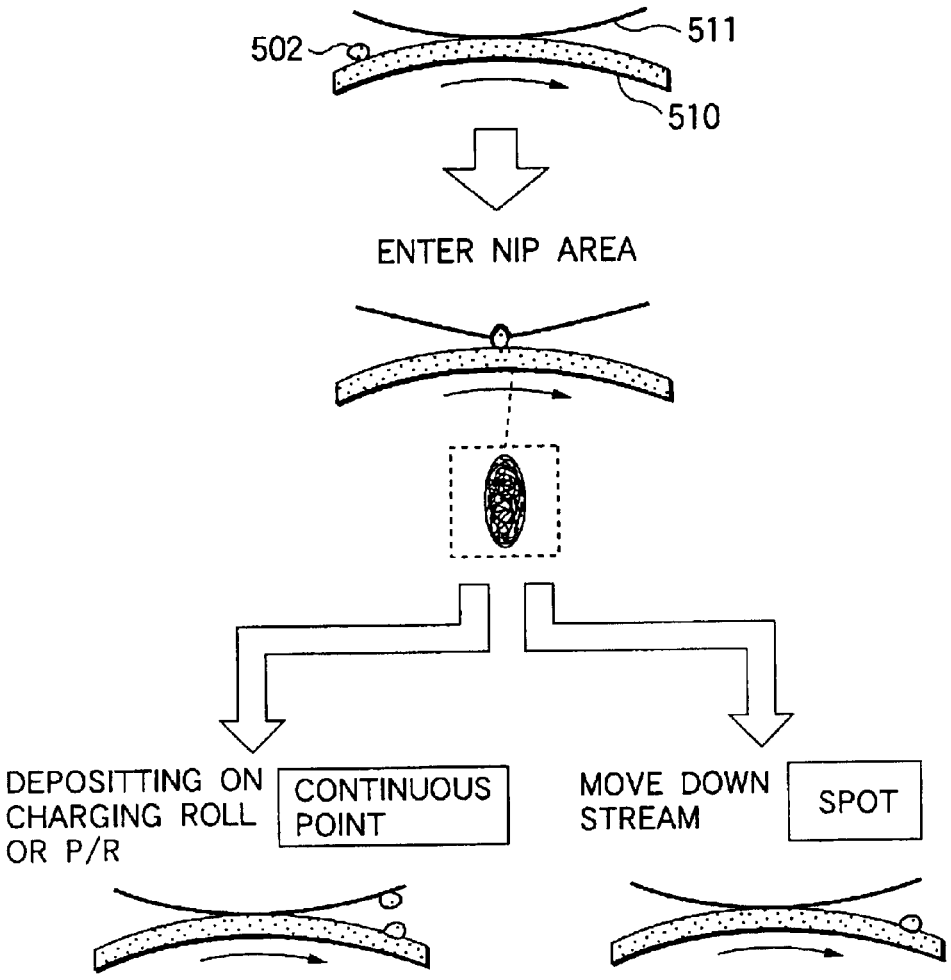
FIG. 20 is a schematic representation to show the principle of producing a spot because of a foreign substance.
Figure 21A:
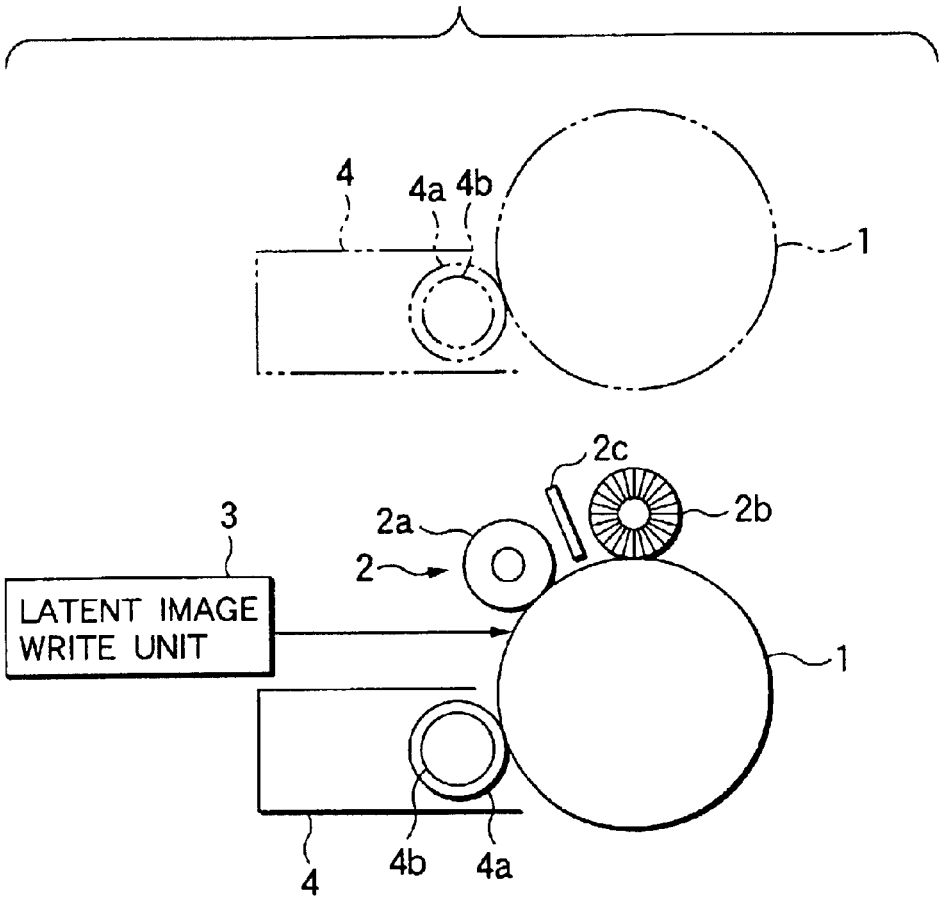
FIG. 21(*a*) is a schematic representation to show an outline of an image formation apparatus and a charger used therewith according to the invention and FIG. 21(*b*) is a schematic representation of the main part thereof.
Figure 21B:
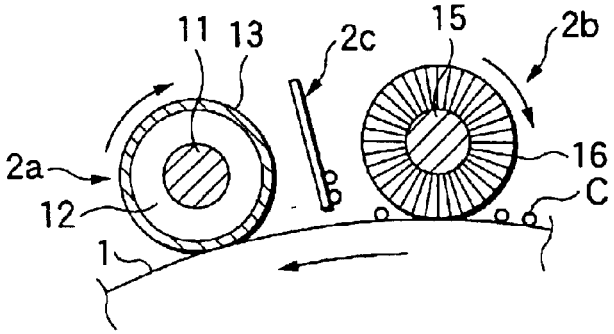

Particularly, in the embodiment, the charging roll 100 comprises a nonmagnetic shaft 101, a sponge-like conductive elastic body 102 placed on the outer periphery of the nonmagnetic shaft 101, and a cylindrical surface layer film 103 for covering the conductive elastic body 102, as shown in FIG. 14(*a*).

As the nonmagnetic shaft 101, a nonmagnetic material having magnetic permeability of 1.05 or less (to such a degree that a magnetic material does not adhere), for example, SUS303 (magnetic permeability 1.05) or more preferably SUS303Cu (magnetic permeability 1.02) is used.

As the sponge-like conductive elastic body 102, preferably a conductive urethane foam body, for example, is used from the viewpoint of low hardness and stably providing a nip area.

Further, as the cylindrical surface layer film 103, preferably a conductive fluorine resin, for example, is used from the viewpoint of providing nip uniformity by an electrostatic attraction force.

Further, in the embodiment, the charging roll 100 has a surface resistance value set to $10^6$ Ω/□ to $10^{8.5}$ Ω/□ from the viewpoint of functioning as a charging member and effectively avoiding a charge failure caused by charge current leakage.

Further, preferably the hardness condition is 90 degrees or less as Asker F hardness from the viewpoint of providing nip uniformity.

As a strength condition of the nonmagnetic shaft 101, preferably the tensile strength is 600 N/mm$^2$ or more from the viewpoint of preventing bend deformation at the center part and providing a charge property over all regions.

Further, a charge bias power supply 104 is connected to the nonmagnetic shaft 101 to apply charge biases different in polarity, VC(+) or VC(−), to the nonmagnetic shaft 101.

In the example, as the bias applying system to the charging roll 100, the charge bias VC(−) is applied in an image formation mode as shown in FIG. 14(*b*) and the charge bias VC(+) is applied in a cleaning mode as shown in FIG. 14(*c*).

In the embodiment, the brush roll 110 comprises a magnetic shaft 111 and brush bristles 112 as a brush-like member placed on the outer periphery of the magnetic shaft 111.

The brush roll 110 is not provided with any drive means and is rotated to follow with rotation of the photoconductor drum 21 by a frictional force acting between the brush bristles 112 and the photoconductor drum 21.

As the magnetic shaft 111, SUM, for example, is used from the viewpoint of easy work and low cost or a shaft provided by plating the SUM surface with Ni is used from the viewpoint of sliding noise prevention and rust prevention.

On the other hand, the brush bristles 112 are provided by bonding a fiber-like member made of an acrylic resin, for example, onto the magnetic shaft 111, for example. PP, rayon, nylon, polyester, PTFE, ETFT, PET, etc., is available as the material of the brush bristles 112.

Preferably, the brush bristles 112 have a resistance value of $10^4$ to $10^5$ Ωcm to provide compatibility between cleaning property and environment dependency.

A removal bias power supply 113 is connected to the brush roll 110 to apply removal biases different in polarity, VR(+) or VR(−), to the magnetic shaft 111.

In the example, as the bias applying system to the brush roll 110, in the image formation mode, as shown in FIG. 14(*b*), the removal bias VR(−) is applied to temporarily collect the toner inverted in the polarity from the surface of the photoconductor drum 21 and to hold the toner until the cleaning mode described later is started. In the cleaning mode, the removal bias VR(+) is applied.

Next, the performance of the charger according to the embodiment is evaluated.

In the model of the embodiment, the charger 22 is placed comparatively close to the developing device 24, for example, and thus is placed under the magnetic field effect of the magnetic force of the magnet roll 202.

In this state, for example, since the charging roll 100 comprises the nonmagnetic shaft 101, even if the charging roll 100 is positioned under the magnetic field effect from the developing device 24, the charging roll 100 is not magnetized.

Thus, even if the carrier G of the developer or the like goes to the charging roll 100 through the photoconductor drum 21 or directly, it is hard for the carrier G of the developer or the like to be deposited on the charging roll 100 and, therefore, the image quality defect like spots caused by depositing the carrier, etc., can be avoided effectively.

Particularly, in the embodiment, since the brush roll 110 as the refresher comprises the magnetic shaft 111, if the brush roll 110 is positioned under the magnetic field effect from the developing device 24, the magnetic shaft 111 is magnetized.

Thus, in the example, in a state in which the carrier of the developer G or the like goes to the brush roll 110 through the photoconductor drum 21 or directly, the carrier, etc., is easy to be deposited on the brush roll 110, magnetic foreign substances such as the carrier are reliably removed with the brush roll 110, and the fear of depositing the carrier, etc., on the charging roll 100 can be avoided more reliably.

Such performance is acknowledged in examples described later.

The DC component of the developing bias was set to 180 to 270 V, Vp-p of the AC component was set to 1.0 to 2.0 kV, and the frequency thereof was set to 1.5 to 10 kHz as the developing conditions of the developing device 24. Although it is considered that carrier jetting is much as compared with the DC component type, the image quality defect like spots was scarcely observed.

The image quality defect like spots was also scarcely observed in a mode wherein the number of revolutions of the developing roll 62 of the developing device 24 was increased in sequence or one developing magnetic pole of the magnet roll 202 was set to 100 mT and its adjacent magnetic pole was set to 50 mT to raise the carrier jet condition.

Further, in the embodiment shown in FIGS. 2 and 3, the charger 22 at the intermediate position between the developing devices 24 positioned consecutively up and down is positioned roughly below the developing part of the upper developing device 24 or is affected by the magnetic field effect from the developing devices 24 positioned consecutively up and down; a phenomenon in which the image quality defect like spots for this image formation unit in the charger 22 is extremely much as compared with that for the image formation unit of any other color does not occur and the image quality defect like spots was scarcely observed as for any color component.

On the other hand, in the embodiment, in the image formation mode, opposite-polarity toner is temporarily held on the charging roll 100 and opposite-polarity toner and carrier are temporarily held on the brush roll 110; the cleaning mode is executed periodically for collecting the opposite-polarity toner and carrier held on the charging roll 100 and the brush roll 110 into the cleaning device 54.

That is, in the embodiment, to collect the opposite-polarity toner and carrier caught by the brush roll 110, for example, the following cleaning mode is executed at one predetermined timing such as before the print operation, after the print operation, every predetermined number of sheets at the continuous printing time:

In the cleaning mode, first, voltage with a potential gradient is applied in order to the charging roll 100 and the brush roll 110 as the refresher of each charger 22, each photoconductor drum 21, the primary intermediate transfer drums 31 and 32, the secondary intermediate transfer drum 33, and the final transfer roll 34 so that the final transfer roll 34 becomes the highest minus potential, whereby the opposite-polarity toner T collected to the charging roll 100 and the opposite-polarity toner T and carrier C collected and held on the brush roll 110 during the print operation are transferred in order to the final transfer roll 34 and are collected by the cleaning device 54 placed in contact with the final transfer roll 34.

Therefore, when such cleaning operation is started, for example, the opposite-polarity toner T and carrier C temporarily held on the brush roll 110 are ejected onto the photoconductor drum 21 and the brush roll 110 is restored to a clean condition.

When cleaning the opposite-polarity toner T thus terminates, the same potential as that at the toner image formation time is given to the charging roll 100, the photoconductor drum 21, the primary intermediate transfer drums 31 and 32, the secondary intermediate transfer drum 33, and the final transfer roll 34; on the other hand, a potential of an opposite polarity to that at the image formation time is given to the primary intermediate brush rolls 51 and 52 and the secondary intermediate brush roll 53 to clean the negative-charged toner deposited on the primary intermediate brush rolls 51 and 52 and the secondary intermediate brush roll 53.

That is, the potential of the opposite polarity to that at the image formation time is given to the primary intermediate brush rolls 51 and 52 and the secondary intermediate brush roll 53, whereby the toner held on the brush rolls 51, 52, 53 is ejected onto the primary intermediate transfer drums 31 and 32 and the secondary intermediate transfer drum 33 and arrives at the final transfer roll 34 via the secondary intermediate transfer drum 33 as with normal toner image transfer and is collected by the cleaning device 54.

Such cleaning operation is executed periodically, whereby the toner of any polarity caught in each brush roll is collected by the cleaning device 54 to clean the brush rolls.

Second Embodiment

A second embodiment of the invention is an embodiment provided by adding a shield plate 120 to the first embodiment. Members identical with those of the first embodiment are denoted by the same reference numerals in the second embodiment and will not be discussed again.

Figure 23:
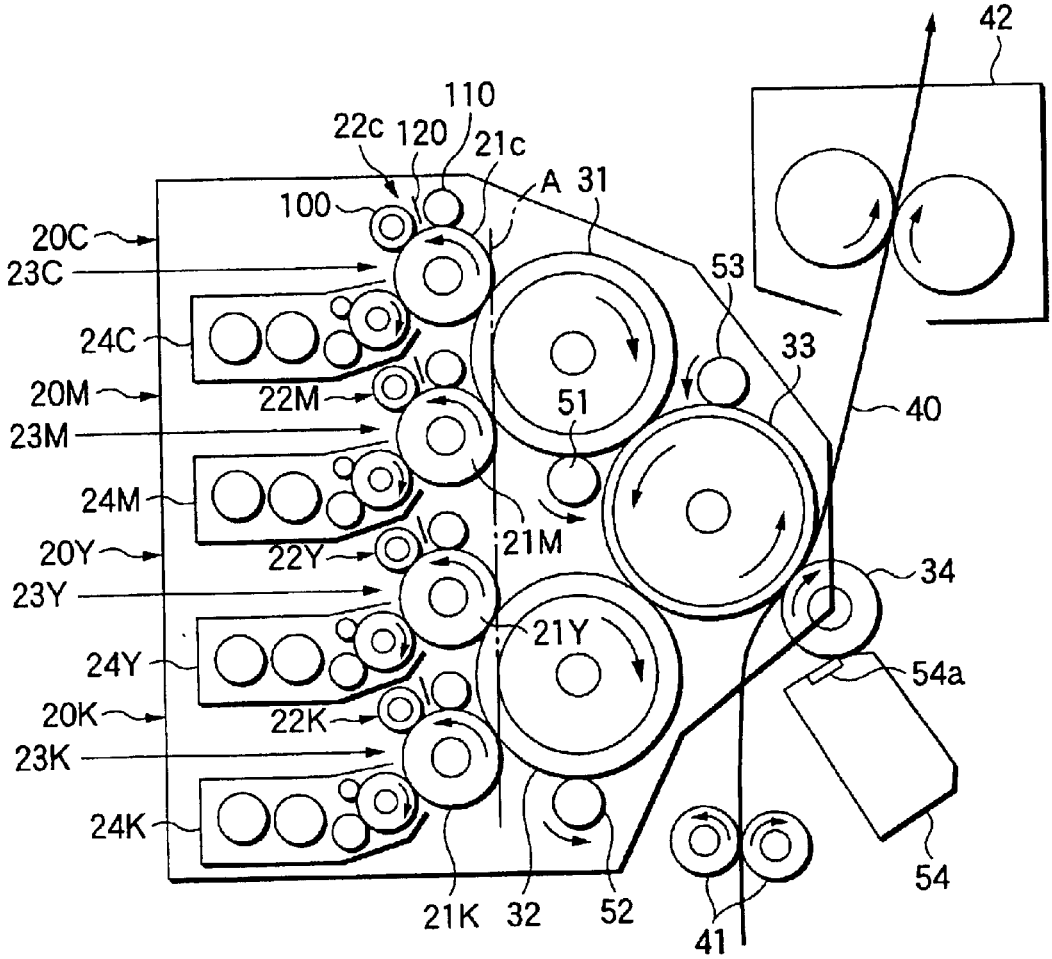
FIG. 23 is a schematic representation to show the general configuration of an image formation apparatus according to a second embodiment to which the invention is applied.

A charger 22 according to the second embodiment comprises a charging roll 100 for charging a photoconductor drum 21, a brush roll 110 as a refresher in the upstream of the charging roll 100, and a shield plate 120 for partitioning the charging roll 100 and the brush roll 110 as shown in FIG. 23, so that foreign substance (remaining toner, carrier, etc.,) on the photoconductor drum 21 is removed with the brush roll 110 to prevent the foreign substance on the photoconductor drum 21 from being transferred to the charging roll 100 side and in addition, an accident in which an aggregate of a carrier lump, etc., spilling from the brush roll 110 goes to the charging roll 100 side is avoided in the presence of the shield plate 120.

Next, the charger of this embodiment will be discussed in detail.

Figure 24:
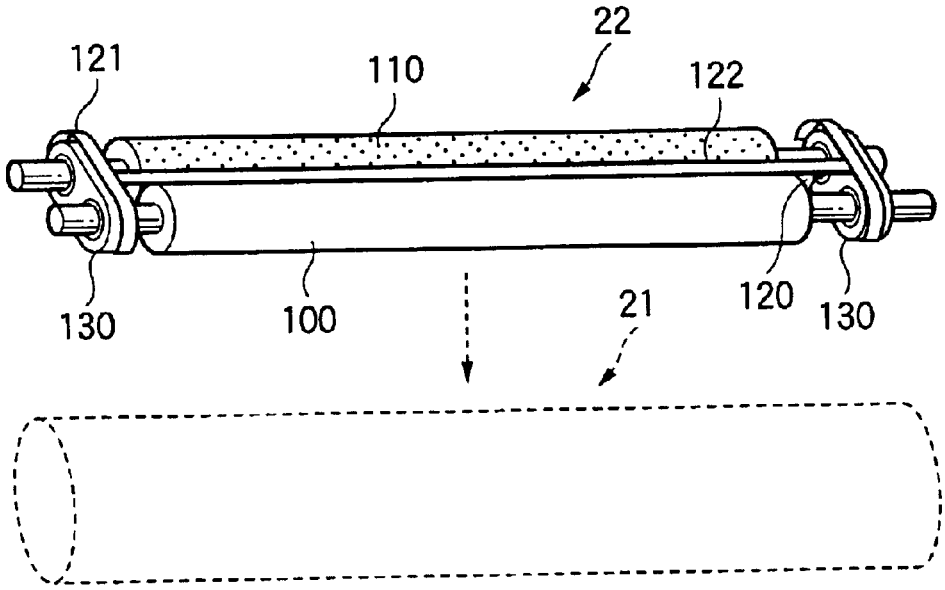
FIG. 24 is a perspective view to show the generation configuration of a charger used in the second embodiment of the invention.

In the embodiment, the charger 22 is one unitized the charging roll 100 for charging the photoconductor drum 21, the brush roll 110 as a refresher in the upstream of the charging roll 100, and the shield plate (partition plate) 120 for partitioning the charging roll 100 and the brush roll 110 as shown in FIG. 24.

Figure 25A:
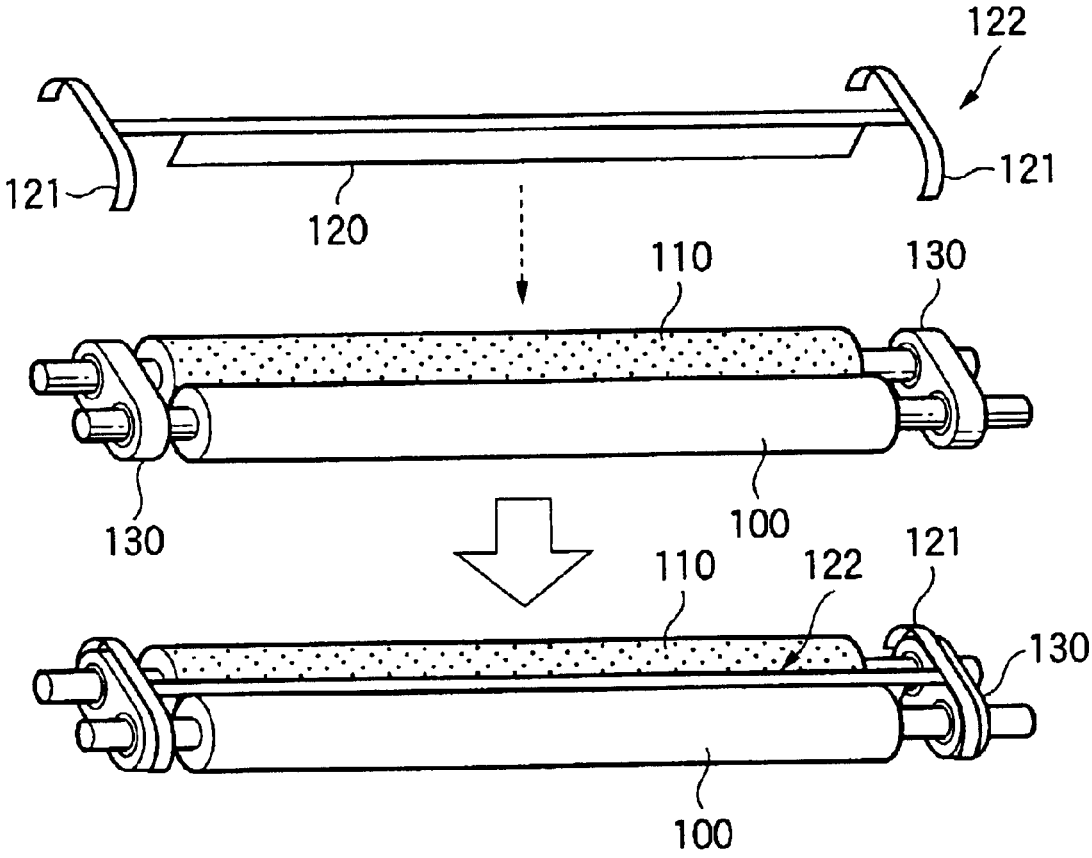
FIGS. 25(*a*) and 25(*b*) are schematic representation to show an assembling process of the charger according to the second embodiment of the invention.
Figure 25B:
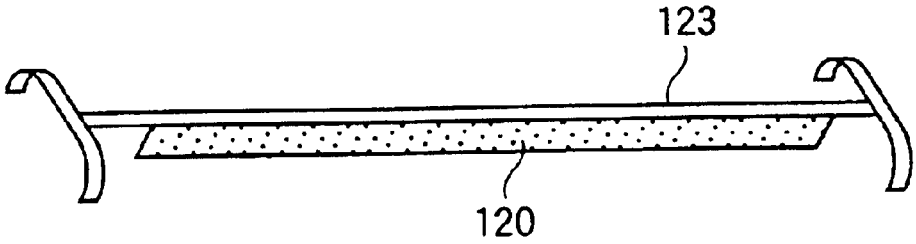

As the attachment structure of the charger 22, as shown in FIGS. 13 and 25(*a*), the charging roll 100 and the brush roll 110 are supported on a pair of bearing members (corresponding to a support frame) 130 to be rotatable and a shield frame 122 formed with a pair of positioning arms 121 integrally at both ends of the shield plate 120 is provided and the positioning arms 121 of the shield frame 122 are positioned and held in the bearing members 130 to place the shield plate 120 of the shield frame 122 between the charging roll 100 and the brush roll 110.

In the embodiment, the shield plate 120 is formed integrally with the shield frame 122, but may be attached to a separate shield frame 123, as shown in FIG. 25(*b*), of course.

In the embodiment, as the material of the shield plate 120, for example, a metal plate such as stainless steel, aluminum, phosphor bronze, brass, zinc steel plate or a resin such as polycarbonate, polyacetal, polypropylene, polystyrene is used.

Figure 27A:
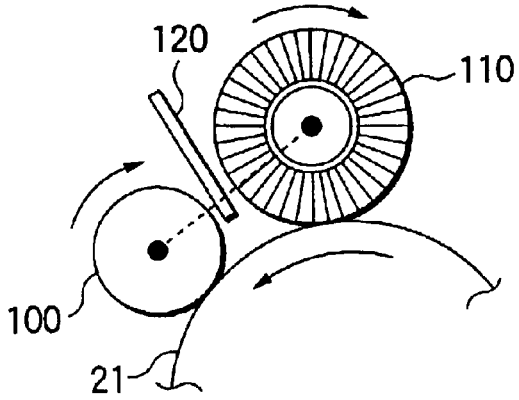
FIG. 27(*a*) is a schematic representation to show an example of a shield plate of the charger according to the second embodiment of the invention and FIGS. 27(*b*) and 27(*c*) are schematic representations to show modifications of the shield plate according to the second embodiment of the invention.
Figure 27B:
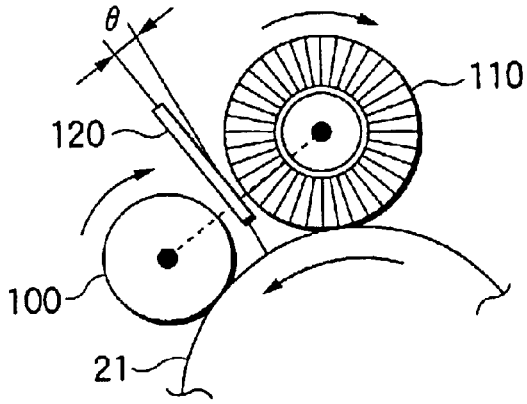
Figure 27C:
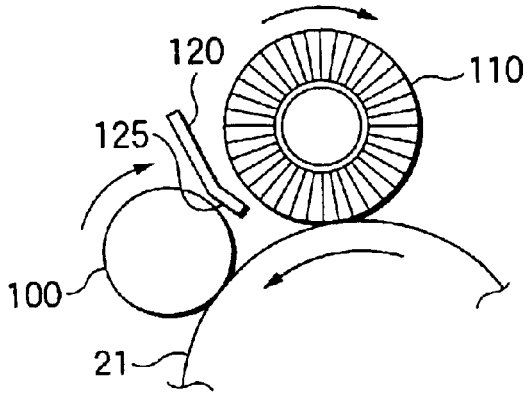

Further, as a layout and a shape of the shield plate 120, as shown in FIG. 27(*a*), a mode in which the straight shield plate 120 is placed roughly perpendicularly to a line connecting the rotation centers of the charging roll 100 and the brush roll 110 may be possible.

The layout, etc., of the shield plate 120 maybe selected appropriately; for example, the shield plate 120 may be inclined by a predetermined angle θ so that the upper end side of the shield plate 120 is brought close to the charging roll 100 and the lower end side thereof is brought close to the brush roll 110, as shown in FIG. 27(*b*) or the shield plate 120 may be formed in a part with a bend part 125 with the lower end side thereof toward the brush roll 110 side, as shown in FIG. 27(*c*).

Figure 28A:
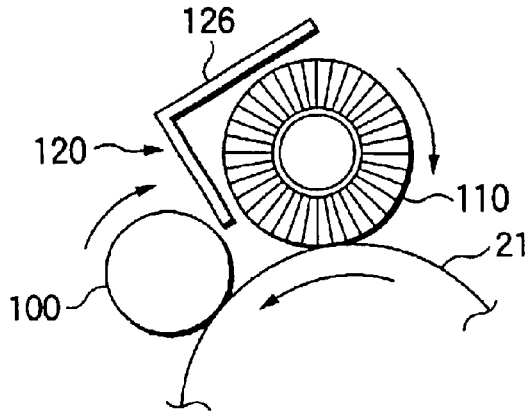
FIGS. 28(*a*) to 28(*c*) are schematic representations to show modifications of the shield plate according to the second embodiment of the invention.
Figure 28B:
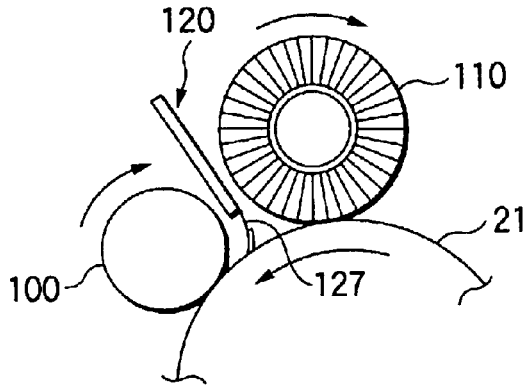
Figure 28C:
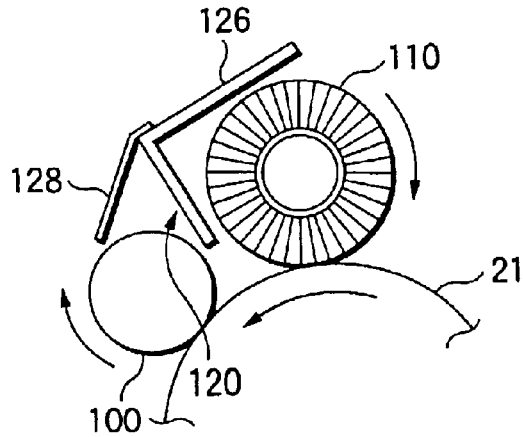

As the shield plate 120, a cover part 126 may be provided so as to cover the brush roll 110, as shown in FIG. 28(*a*), an elastic seal film 127 may be provided in a lower end part of the shield plate 120 and may be brought into elastic contact with the photoconductor drum 21, as shown in FIG. 28(*b*), or the shield plate 120 may be provided with an elastic seal film 128 coming in elastic contact with the charging roll 100 in addition to the cover part 126 covering the brush roll 110, as shown in FIG. 28(*c*).

The thickness of the shield plate 120 is set to about 0.1 to 3.0 mm.

If the shield plate 120 is too thin, it is not preferred because the shield plate 120 comes in contact with the brush roll 110, etc. If the shield plate 120 is too thick, it is not preferred because the shield plate 120 interferes with the upper developing device or a force is required at the assembling time with the charging roll 100 and the brush roll 110.

Further, a gap d between the shield plate 120 and the photoconductor drum 21 (see FIG. 30) may be selected appropriately; the gap d is set so that, at least, the lower end part of the shield plate 120 is positioned below the line connecting the rotation centers of the charging roll 100 and the brush roll 110 so that an aggregate of a carrier lump, etc., from the brush roll 110 can collide with the shield plate 120.

In a case of the shield plate 120 formed of a magnetic material, for example, SPCC, SGCC, SUS430, a zinc-plated steel plate, etc., may be used.

Further, in the embodiment, suction bias Vs(+), Vs(−) is applied to the shield plate 120.

The applying way of the suction bias may be selected appropriately; in the example, a voltage from a charge bias power supply 104 is applied through a voltage divider 129 of a Zener diode, etc.

As the suction bias, a voltage of about 0 to −1000 having the same polarity as the brush roll 110 (for example, minus (negative) in an image formation mode) is applied.

It may be set to an intermediate bias (−500 to −900 V) between the brush roll 110 (−400 to −500 V) and the charging roll 100 (−900 to −1000 V) and an electric field may be formed between the brush roll 110 and the shield plate 120.

In doing so, although carrier has a plus (positive) polarity and thus first is deposited on the brush roll 110, the surface carrier can be attracted to the shield plate 120 side by the electric field between the brush roll 110 and the shield plate 120.

Next, the performance of the charger according to the embodiment is evaluated.

Figure 29A:
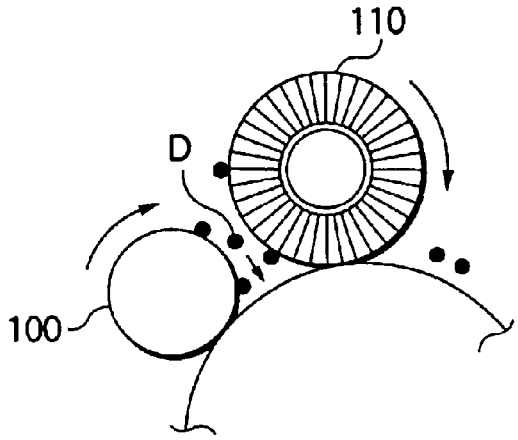
FIG. 29(*a*) is a schematic representation to show an operation example of a comparative model, FIG. 29(*b*) is a schematic representation to show an operation example of the charger according to the model of the second embodiment of the invention, and FIG. 29(*c*) is a schematic representation to show an operation example of the charger according to the modified model of the second embodiment of the invention.
Figure 29B:
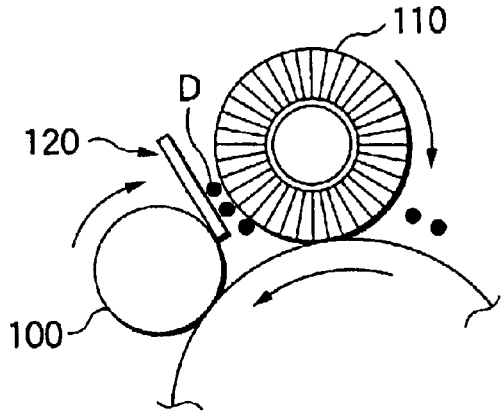
Figure 29C:
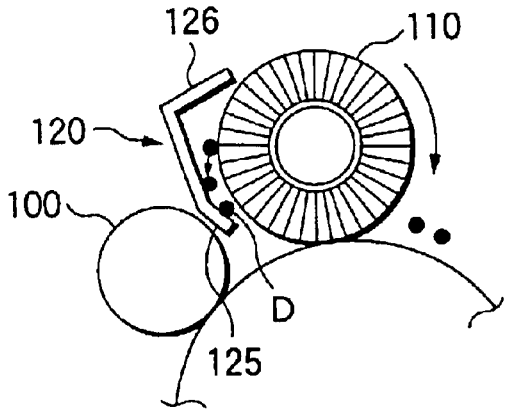

As shown in FIG. 29(*a*), in a case of providing no shield plate 120, it is feared that an aggregate D of a carrier lump, etc., spilling from the brush roll 110 may collide directly with the charging roll 100 and be deposited thereon.

In this state, if the aggregate D enters the nip between the charging roll 100 and the photoconductor drum 21, it is feared that a charge failure may occur corresponding to the aggregate D portion to cause an image quality defect like spots to occur.

Figure 32:
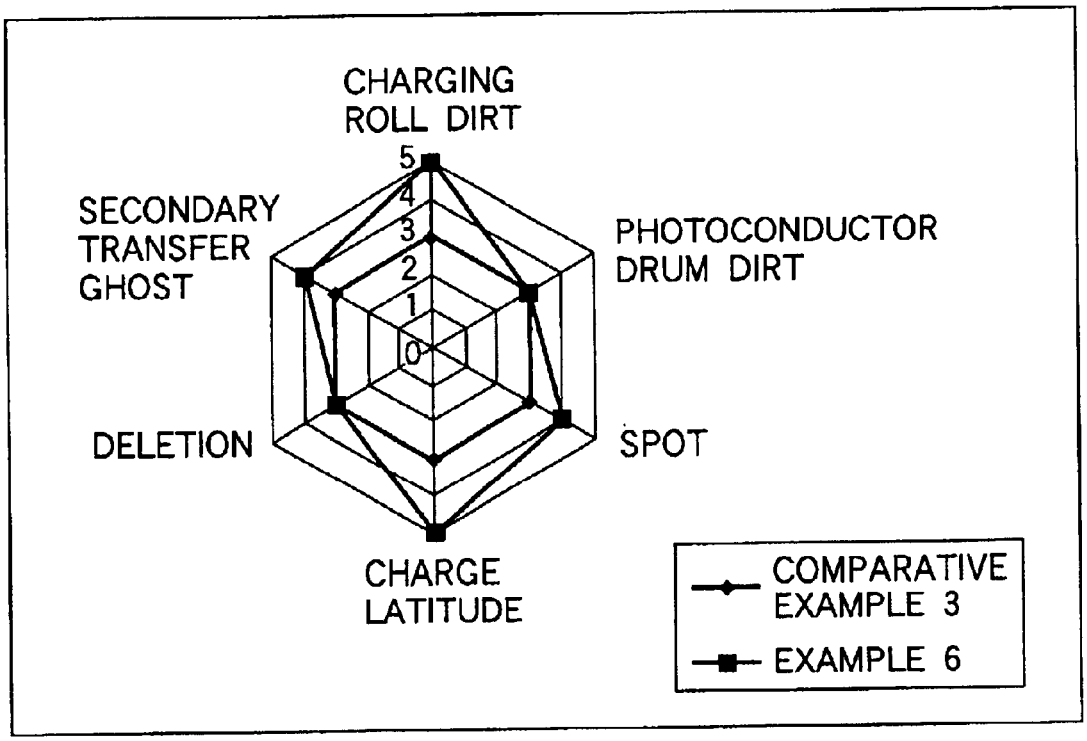
FIG. 32 is a schematic representation to show evaluation of spot occurrence state, charging roll dirt, etc., in an example 6.
Figure 33:
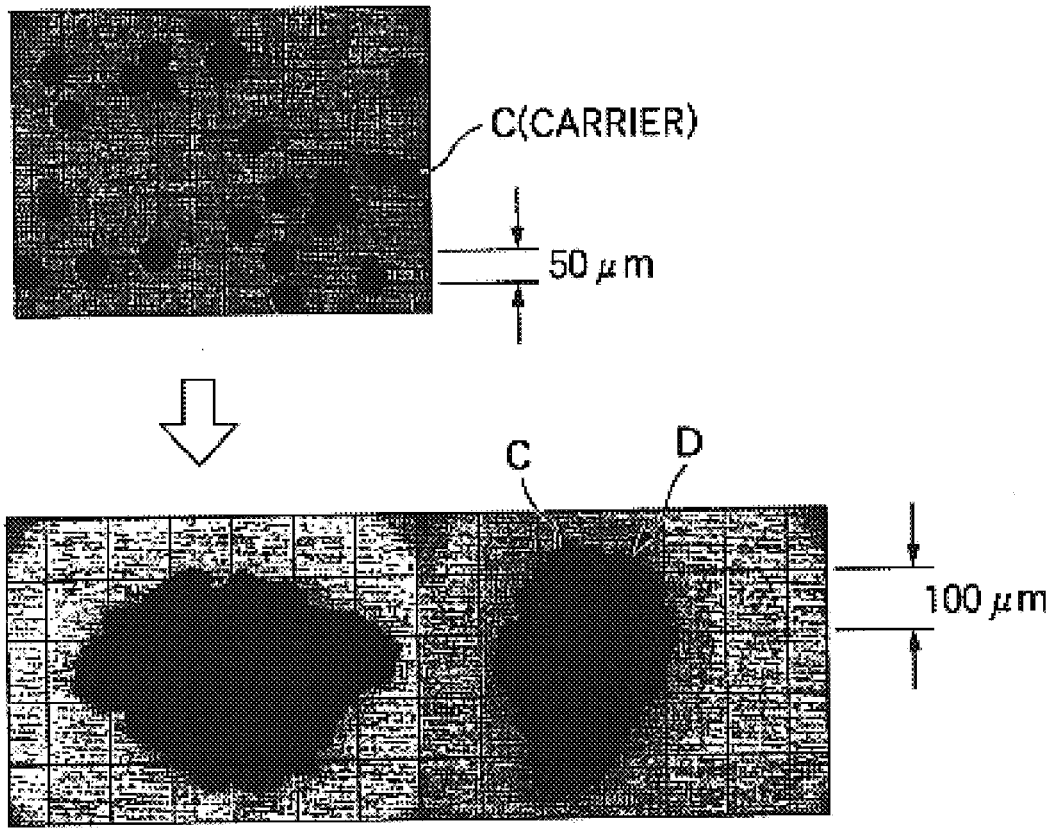
FIG. 33 is a schematic representation to show a carrier lump jetting from a brush roll.

The aggregate D grows to a scale of about several 100 $\mu$m as a result of aggregating of a plurality of carrier particles C each being about 40 to 50 $\mu$m, for example, as shown in FIG. 32.

In contrast, in the model of the embodiment, as shown in FIG. 29(*b*), the aggregate D of a carrier lump, etc., spilling from the brush roll 110 collides with the shield plate 120 and then is pulverized into small particles and the small particles move to the charging roll 100 side through the surface of the photoconductor drum 21.

At this time, the small particles into which the aggregate D is pulverized (not shown) enter the nip area between the charging roll 100 and the photoconductor drum 21, but the particles are extremely small and thus a charge failure does not occur in parts corresponding to the small particles.

Thus, the image quality defect like spots scarcely appears.

As shown in FIG. 29(*c*), in the modified model of the embodiment, the aggregate D spilling from the brush roll 110 reliably collides with the shield plate 120 in the presence of the bend part 125 of the shield plate 120 and the aggregate D deposited on the surface of the brush roll 110 is blocked by the cover part 126 of the shield plate 120 and easily drops and the aggregate D can be more powerfully pulverized into small particles accordingly.

Figure 26A:
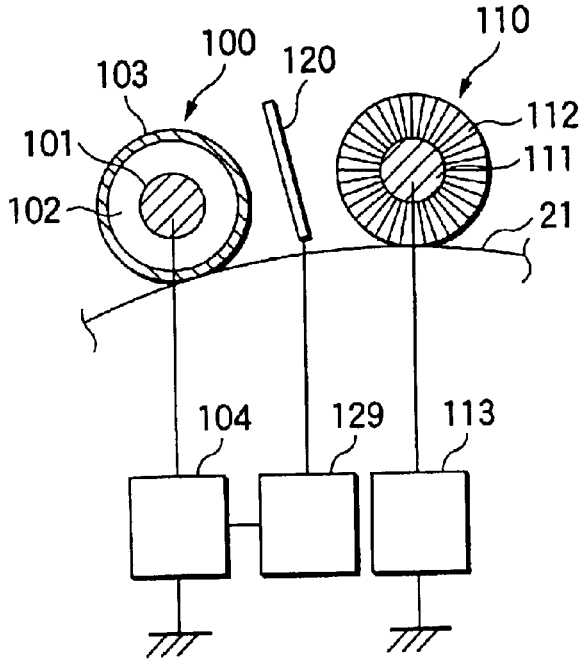
FIG. 26(*a*) is a schematic representation to show the details of the charger according to the second embodiment of the invention, FIG. 26(*b*) is a schematic representation to show an operation state in an image formation mode of the charger, and FIG. 26(*c*) is a schematic representation to show an operation state in a cleaning mode of the charger.
Figure 26B:
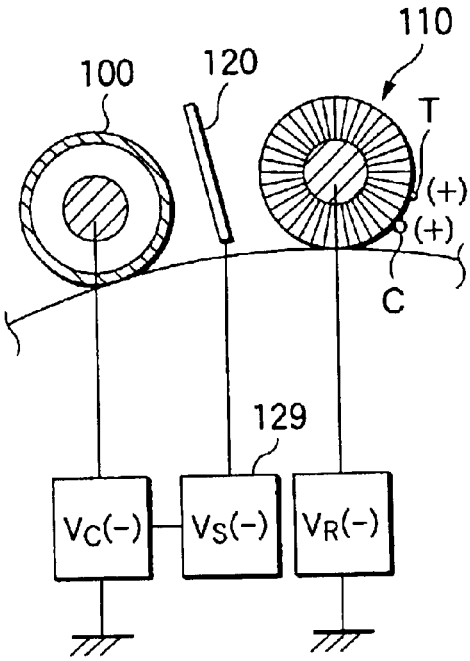
Figure 26C:
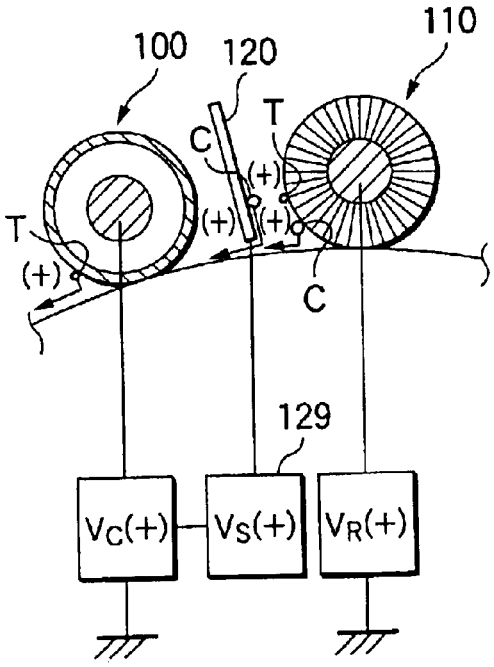

In the cleaning mode, as shown in FIG. 26(*c*), the carrier C, etc., deposited on the shield plate 120 is transferred to the side of a final transfer roll 34 in sequence and is collected into a cleaning device 54.

Third Embodiment

A third embodiment of the invention is an embodiment wherein as the cylindrical surface layer film 103 in the first embodiment, a material having a Young's modulus of 0.6 GPa or less, such as a thermoplastic polyester elastomer (0.2 GPa), is used and the thickness is set to 300 $\mu$m or less. Other than the above described points, the third embodiment has the same construction as the first embodiment.

Next, the performance of a charger according to the embodiment is evaluated.

In a model of the embodiment, a surface layer film 103 uses a thermoplastic polyester elastomer having a Young's modulus of 0.6 GPa or less and thus if carrier is caught between the surface layer film 103 and a photoconductor drum 21, the surface layer film 103 with low rigidity becomes deformed so as to envelop the carrier, resulting in occurrence of only small spots.

Thus, if carrier intervenes in the nip area between the surface layer film 103 and the photoconductor drum 21, it is scarcely feared that a charge failure will occur in a large area, and an image quality defect like spots is scarcely noticeable.

On the other hand, the surface layer film 103 has a low Young's modulus and thus is easily attracted to the photoconductor drum 21 side and moves following the curvature of the photoconductor drum 21. Thus, the discharge area between the surface layer film 103 and the photoconductor drum 21 widens and a latent image history on the photoconductor drum 21 causing a charge ghost to occur is sufficiently eliminated.

Fourth Embodiment

A fourth embodiment of the invention is an embodiment wherein as the cylindrical surface layer film 103 in the first embodiment, a material having a Young's modulus of 3.0 GPa or more, such as a polyimide resin, is used and the thickness is set to 20 to 60 $\mu$m. Other than the above described points, the third embodiment has the same construction as the first embodiment.

In this embodiment, a charging roll 100 comprises a cylindrical surface layer film 103 having a resistance value (surface resistance value) set in a range of $10^6$ Ω/□ to $10^{8.5}$ Ω/□ from the viewpoints of functioning as a charging member and effectively avoiding a charge failure caused by charge current leakage.

Next, the performance of a charger according to the embodiment is evaluated.

In a model of the embodiment, the surface layer film 103 uses a polyimide resin having a Young's modulus of 3.0 GPa or more and thus if carrier is caught between the surface layer film 103 and a photoconductor drum 21, the surface layer film 103 itself with high rigidity is firm to hardly receive the effect of an internal sponge-like conductive elastic body 102 accordingly and the caught carrier is easily removed.

Thus, it is scarcely feared that carrier will intervene in the nip area between the surface layer film 103 and the photoconductor drum 21, cause a charge failure to occur, and an image quality defect like spots scarcely occurs.

On the other hand, the surface layer film 103 has a high Young's modulus and thus is hard to be damaged by the carrier and it is not feared either that toner, etc., will accumulate in a defect part.

EXAMPLE 1

In an example 1 comprising the model of the embodiment, the distance between the thin layer area regulation position and blast (corresponding to the rough surface work part 91 subjected to blast work) end part and the distance between the paper end part and blast (corresponding to the rough surface work part 91 subjected to blast work) end part were changed and end part spots caused by BCO (Beads Carry Over)/carrier scatter were evaluated as ○, Δ, X (○: Good, Δ: Almost good, X: NG). Then, the result shown in FIG. 15(*a*) was provided.

According to the figure, it is seen that if the thin layer area regulation position is outside the blast end part position, no end part spots are observed.

Similar parameter change was made and fogging at the upper end part of the photoconductor drum was evaluated by shutting down during printing and executing tape transfer. Then, the result shown in FIG. 15(*b*) was provided.

According to the figure, it is seen that if the thin layer area regulation position is outside the blast end part position, fogging at the upper end part of the photoconductor drum scarcely occurs.

Further, similar parameter change was made and the dirty level of the drive gear in the periphery of the developing roll end part was evaluated. Then, the result shown in FIG. 15(*c*) was provided.

According to the figure, it is seen that if the thin layer area regulation position is outside the blast end part position, the dirty level of the drive gear in the periphery of the developing roll end part scarcely introduces a problem.

COMPARATIVE EXAMPLE 1

In the charger of the model of the embodiment, the charging shaft (charging roll shaft) was made of SUM and the refresher shaft (brush roll shaft as refresher) was made of SUM and the occurrence rates of spots (independent spots and continuous spots) were examined according to grade of spot size. Then, the result as shown in FIG. 16 was provided.

According to the figure, it was acknowledged that large background spots (BKG spots) and large image part spots (IMG spots) to some extent are observed.

EXAMPLE 2

In the charger of the model of the embodiment, the charging shaft was made of SUS303Cu and the refresher shaft was made of SUM and the occurrence rates of spots (independent spots and continuous spots) were examined according to grade of spot size. Then, the result as shown in FIG. 17 was provided.

According to the figure, it was acknowledged that the occurrence rates of BKG spots and image part spots are extremely lessened as compared with those of the comparative example 1.

EXAMPLE 3

In the charger of the model of the embodiment, the charging shaft was made of SUS303Cu and the refresher shaft was made of SUS303Cu and the occurrence rates of spots (independent spots and continuous spots) were examined according to grade of spot size. Then, the result as shown in FIG. 18 was provided.

According to the figure, it was acknowledged that the occurrence rates of BKG spots and image part spots are extremely lessened as compared with those of the comparative example, but are a little high as compared with those of the example 2.

EXAMPLE 4

Figures 30A, 30B:
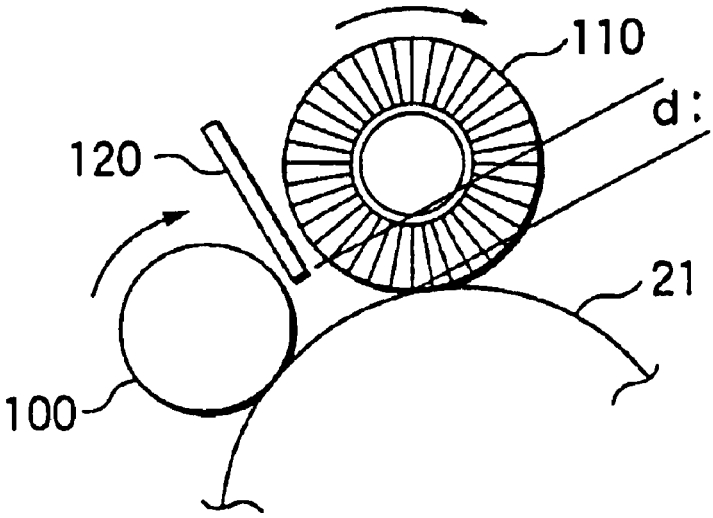
FIG. 30(*a*) is a schematic representation to show an experimental model according to an example 4, and FIG. 30(*b*) is a chart to show a relationship within a gap between a shield plate and a photoconductor drum, and the presence or absence of spot occurrence.

In an example 4 shown in FIG. 30(*a*), the gap d between the shield plate 120 and the photoconductor drum 21 was changed and the presence or absence of an image quality defect like spots at the time was examined. Then, the result shown in FIG. 30(*b*) was provided.

According to FIG. 30(*b*), when the gap d is 0, occurrence of a spot is not observed in the initial state, but the developer accumulates with time and is deposited on the photoconductor drum 21 or the surface of the photoconductor drum 21 is easily damaged and thus the gap d being 0 is not preferred.

When the gap d becomes about 4.0 mm, it is feared that the developer dropping from the brush roll 110 will not collide with the shield plate 120, and occurrence of a spot was observed.

Therefore, in the example, it was acknowledged that occurrence of a spot is not observed if the gap d was $0<d<4$ mm.

EXAMPLE 5

Figure 31:
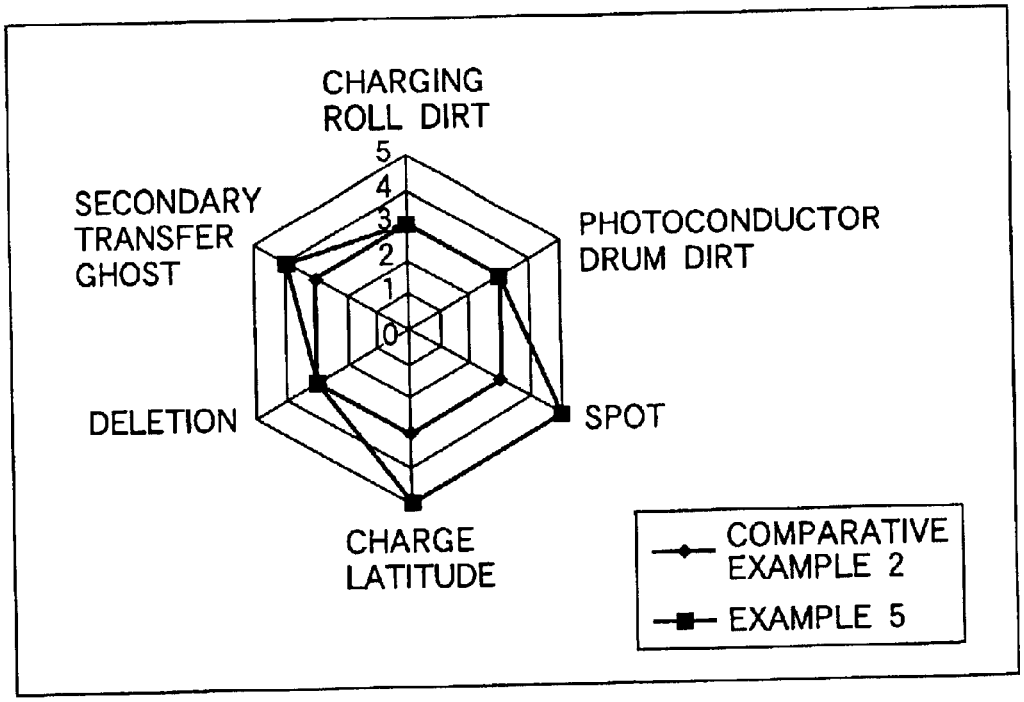
FIG. 31 is a schematic representation to show evaluation of spot occurrence state, charging roll dirt, etc., in an example 5.

Spot occurrence state, photoconductor drum dirt, charging roll dirt, secondary transfer ghost (transfer image history: Mainly affected by the fact that filming occurs on the intermediate transfer drum by transfer interaction with the intermediate transfer drum, causing the effective surface potential on the intermediate transfer drum to differ from the setup potential), deletion(deletion under high humidity), charge latitude ((1) Charge uniformity: Better as the charge potential difference in axial direction, process direction is smaller, (2) Charge capability: Is evaluated based on the charge potential difference between the first and second cycles (cycle 1-cycle 2) and is better if no charge potential difference exists. Better if a predetermined potential is reached in the first cycle) were evaluated between the model of the third embodiment (example 5) and a control model with the surface layer film 103 made of PVdF (comparative example 1). Then, it was acknowledged that the example 5 is superior to the comparative example 2 in points of the spot occurrence state, the secondary transfer ghost, and the charge latitude, as shown in FIG. 31.

EXAMPLE 6

Spot occurrence state, photoconductor drum dirt, charging roll dirt, secondary transfer ghost (transfer image history: Mainly affected by the fact that filming occurs on the intermediate transfer drum by transfer interaction with the intermediate transfer drum to cause the effective surface potential on the intermediate transfer drum to differ from the setup potential), deletion(deletion under high humidity), charge latitude ((1) Charge uniformity: Better as the charge potential difference in axial direction, process direction is smaller, (2) Charge capability: Is evaluated based on the charge potential difference between the first and second cycles (cycle 1-cycle 2) and is better if no charge potential difference exists. Better if a predetermined potential is reached in the first cycle) were evaluated between the model of the embodiment 4 (example 6) and a control model with the surface layer film 103 made of PVdF (comparative example 3). Then, it was acknowledged that the example 6 is superior to the comparative example 3 in points of the spot occurrence state, the charging roll dirt, the secondary transfer ghost, and the charge latitude, as shown in FIG. 32.

As described above, according to the invention, to dispose the developing device and the charger, the charging member of the charger may be disposed under the effect of a magnetic field produced by the magnetic field production member of the developing device and may be made of a nonmagnetic material, so that while the developing device and the charger are placed close to each other, magnetization of the charging member under the effect of the magnetic field from the developing device can be avoided effectively.

Thus, while the image formation apparatus is miniaturized, deposition of carrier, etc., of a magnetic member on the charging member can be prevented effectively and an image quality defect like spots accompanying deposition of carrier, etc., on the charging member can be prevented effectively.

According to another mode of the invention, to dispose the charger having the removal member disposed in the upstream of the charging member for removing a deposit on the photoreceptor and the developing device, the charging member of the charger may be disposed under the effect of a magnetic field produced by the magnetic field production member of the developing device and may be made of a nonmagnetic material and on the other hand, the removal member of the charger may be disposed under the effect of a magnetic field produced by the magnetic field production member of the developing device and may be made of a magnetic material, so that while the developing device and the charger are placed close to each other, magnetization of the charging member under the effect of the magnetic field from the developing device can be avoided effectively and in contrast, the removal member can be magnetized aggressively.

Thus, while the image formation apparatus is miniaturized, deposition of carrier, etc., of a magnetic member on the removal member can be promoted and deposition of carrier, etc., of a magnetic member on the charging member can be prevented effectively and accordingly an image quality defect like spots accompanying deposition of carrier, etc., on the charging member can be prevented effectively.

Further, according to the charger according to the invention, to construct an image formation apparatus comprising the charger placed close to the developing device, an image quality defect like spots accompanying deposition of carrier, etc., on the charging member can be prevented effectively, so that a small-sized image formation apparatus for effectively suppressing image quality defects like spots can be constructed easily.

According to the invention, the removal member is disposed in the upstream of the charging member, the charging member and the removal member are partitioned by the partition member, and the removed substance of an aggregate of a carrier lump, etc., peeled off from the removal member is made to collide with the partition member, so that the removed substance of an aggregate of a carrier lump, etc., peeled off from the removal member is pulverized into small particles as it is made to collide with the partition member, and an accident in which the removed substance peeled off from the removal member directly collides with and is deposited on the charging member can be prevented effectively.

Thus, an accident in which the removed substance of an aggregate of a carrier lump, etc., peeled off from the removal member enters the nip area between the charging member and the photoreceptor can be avoided effectively and accordingly a charging failure occurring in the presence of the removed substance can be eliminated and an image quality defect like spots can be avoided effectively.

According to the charger according to the invention, simply the partition member may be placed between the charging member and the removal member, so that a small-sized image formation apparatus for well suppressing image quality defects like spots can be constructed easily as a simple configuration.

According to the invention, the charging member of the charger is coated at least on the outermost peripheral surface with the cylindrical surface layer film formed of a polymeric material and the material of the surface layer film has a Young's modulus of 0.6 GPa or less, so that the surface layer film material of the charging member is optimized and occurrence of an image quality defect like spots and a charge ghost can be prevented effectively.

Thus, an image formation apparatus for making it possible to effectively suppress image quality defects like spots without being affected by a charge ghost can be constructed easily if the charger is built in the image formation apparatus.

According to the invention, the charging member of the charger is coated at least on the outermost peripheral surface with the cylindrical surface layer film formed of a polymeric material and the material of the surface layer film has a Young's modulus of 3.0 GPa or more, so that the surface layer film material of the charging member is optimized and occurrence of an image quality defect like spots and dirt on the charge member surface can be prevented effectively.

Thus, an image formation apparatus for making it possible to effectively suppress image quality defects like spots while the life of the charger is prolonged can be constructed easily if the charger is built in the image formation apparatus.

According to the developing device according to the invention, the end part configuration of the developer support in a dual-component developing device (the relationship between the thin layer area regulation position and the rough surface work part and the relationship between the thin layer area regulation position and the magnetic field production member) is improved, whereby while the apparatus itself is miniaturized, an increase in the developer layer thickness at an end part of the developer support is suppressed effectively, so that an image quality defect accompanying an increase in the developer layer thickness at the end part of the developer support can be avoided effectively.

An image formation apparatus using such a developing device can easily form an image with an image quality defect well suppressed while satisfying the demand for miniaturization of image formation apparatus.

What is claimed is:

1. An image formation apparatus comprising:

a photoreceptor;

a charger having a charging member for charging the photoreceptor;

a latent image write unit for writing an electrostatic latent image onto the photoreceptor charged by the charger; and a developing device having a developer support including a magnetic field production member, for rendering visible the electrostatic latent image written by the latent image write unit with a developer, wherein the charging member of the charger is disposed under effect of a magnetic field produced by the magnetic field production member of the developing device; and the charging member is made of a nonmagnetic material.

2. The image formation apparatus according to claim 1, wherein the charging member is made of a nonmagnetic material having magnetic permeability of 1.05 or less.

3. The image formation apparatus according to claim 1, wherein the charging member is made of a nonmagnetic material comprising SUS3O3 added copper.

4. The image formation apparatus according to claim 1, wherein the charging member comprises a sponge-like conductive elastic body on a nonmagnetic shaft thereof.

5. The image formation apparatus according to claim 1, wherein an outer periphery of a conductive elastic body is coated with a cylindrical film.

6. The image formation apparatus according to claim 1, wherein the charging member comprises a nonmagnetic shaft having 600 $N/mm^2$ or more in the tensile strength.

7. The image formation apparatus according to claim 1, wherein the developer support of the developing device rotates at the number of revolutions to such an extent that a part of the developer scatters against a magnetic force produced by the magnetic filed-field production member.

8. The image formation apparatus according to claim 1, wherein the magnetic field production member of the developing device has a developing magnetic pole set to 100 mT or more; and an adjacent magnetic pole set to 50 mT or more is disposed at a part adjacent to the developing magnetic pole.

9. An image formation apparatus according claim 1, wherein the charger further comprises a removal member disposed in contact with the photoreceptor in the upstream of the charging member, for removing a deposit on the photoreceptor;

the removal member is disposed under the effect of a magnetic field produced by the magnetic field production member of the developing device; and the removal member is made of a magnetic material.

10. The image formation apparatus according to claim 9, wherein the removal member is provided with a brush-like member on a magnetic shaft thereof.

11. The image formation apparatus according to claim 9, wherein the removal member comprises a magnetic shaft made of SUM.

12. The image formation apparatus according to claim 9, wherein the removal member comprises a magnetic shaft made of SUM having a surface plated with nickel.

13. The image formation apparatus according to claim 9, wherein the removal member is provided with a brush-like member by bonding a fiber-like member onto a magnetic shaft.

14. The image formation apparatus according to claim 9, wherein a predetermined removal bias is applied to the removal member.

15. The image formation apparatus according to claim 9, wherein a bias for holding an opposite-polarity toner and a removal bias for transferring the held opposite-polarity toner to the photoreceptor are applied to the removal member.

16. The image formation apparatus according to claim 9, wherein a plurality of the photoreceptors, a plurality of the chargers, and a plurality of the developing devices are disposed in a vertical direction;

any one of the chargers is disposed at an intermediate position between the developing devices positioned consecutively up and down; and the removal member of the charger is positioned approximately below a developing part of the upper developing device.

17. The image formation apparatus according to claim 9, wherein a plurality of the photoreceptors, a plurality of the chargers, and a plurality of the developing devices are disposed in a vertical direction;

any one of the chargers is disposed at an intermediate position between the developing devices positioned consecutively up and down; and the removal member of the charger is disposed under the effect of the magnetic field produced by the magnetic field production member of each of the developing devices positioned consecutively up and down.

18. The image formation apparatus according to claim 1, wherein a plurality of the photoreceptors, a plurality of the chargers, and a plurality of the developing devices are disposed in a vertical direction;

any one of the chargers is disposed at an intermediate position between the developing devices positioned consecutively up and down; and the charging member of the charger is positioned approximately below a developing part of the upper developing device.

19. The image formation apparatus according to claim 1, wherein a plurality of the photoreceptors, a plurality of the chargers, and a plurality of the developing devices are disposed in a vertical direction;

any one of the chargers is disposed at an intermediate position between the developing devices positioned consecutively up and down; and the charging member of the charger is disposed under the effect of the magnetic field produced by the magnetic field production member of each of the developing devices positioned consecutively up and down.

20. An image formation apparatus comprising:

a photoreceptor;

a charger having a charging member for charging the photoreceptor, a removal member disposed in contact with the photoreceptor in the upstream of the charging member, for removing a deposit on the photoreceptor, and a partition member for partitioning the charging member and the removal member, and causing a removed substance peeled off from the removal member to collide therewith;

a latent image write unit for writing an electrostatic latent image onto the photoreceptor charged by the charger;

a developing device having a developer support including a magnetic field production member, for rendering visible the electrostatic latent image written by the latent image write unit with a developer; and wherein the partition member is disposed under the effect of a magnetic field produced by the magnetic field production member of the developing device.

21. The image formation apparatus according to claim 20, wherein the partition member is placed out of contact with the photoreceptor.

22. The image formation apparatus according to claim 20, wherein the partition member extends to below a line connecting rotation centers of the charging member and the removal member.

23. The image formation apparatus according to claim 20, wherein the partition member is placed out of contact with the removal member.

24. The image formation apparatus according to claim 20, wherein a suction bias having the same polarity as a charge bias applied to the charging member is applied to the partition member.

25. The image formation apparatus according to claim 20, wherein the partition member is made of a magnetic material.

26. The image formation apparatus according to claim 20, wherein the charging member, the removal member, and the partition member are positioned and supported on a common support frame and are assembled through the support frame into a main unit of the apparatus in one piece.

27. The image formation apparatus according to claim 20, wherein a plurality of the photoreceptors, a plurality of the chargers, and a plurality of the developing devices are disposed in a vertical direction;

any one of the chargers is disposed at an intermediate position between the developing devices positioned consecutively up and down; and the charging member of the charger is positioned approximately below a developing part of the upper developing device.

28. An image formation apparatus comprising:

a photoreceptor;

a charger having a charging member for charging the photoreceptor;

a latent image write unit for writing an electrostatic latent image onto the photoreceptor charged by the charger; and a developing device having a developer support including a magnetic field production member, for rendering visible the electrostatic latent image written by the latent image write unit with a developer, wherein the charging member of the charger is coated at least on an outermost peripheral surface with a cylindrical surface layer film formed of a polymeric material; and a material of the surface layer film has a Young's modulus of 0.6 GPa or less.

29. The image formation apparatus according to claim 28, wherein the material of the surface layer film is a thermoplastic polyester elastomer.

30. The image formation apparatus according to claim 28, wherein the charging member comprises a sponge-like conductive elastic body on a support shaft thereof; and the conductive elastic body is coated on an outer periphery with the cylindrical surface layer film.

31. The image formation apparatus according to claim 30, wherein the sponge-like conductive elastic body of the charging member is a conductive urethane foam.

32. The image formation apparatus according to claim 28, wherein the surface layer film of the charging member has a resistance value in a range of $10^6$ Ω/□ to $10^{8.5}$ Ω/□.

33. The image formation apparatus according to claim 28, wherein the charging member has Asker F hardness of 90 degrees or less.

* * * * *